US009354583B2

(12) United States Patent
Yamamoto et al.

(10) Patent No.: US 9,354,583 B2
(45) Date of Patent: May 31, 2016

(54) INFORMATION PROCESSING APPARATUS, METHOD, AND STORAGE MEDIUM FOR GENERATING IMAGE DATA SPECIFYING A TYPE OF SURFACE EFFECT

(71) Applicants: Teruyoshi Yamamoto, Kanagawa (JP); Naoyuki Urata, Kanagawa (JP); Kanna Iinuma, Kanagawa (JP); Ken Mitsui, Kanagawa (JP); Yuu Yamashita, Kanagawa (JP); Hiroyuki Abiru, Kanagawa (JP); Hiroo Kitagawa, Kanagawa (JP)

(72) Inventors: Teruyoshi Yamamoto, Kanagawa (JP); Naoyuki Urata, Kanagawa (JP); Kanna Iinuma, Kanagawa (JP); Ken Mitsui, Kanagawa (JP); Yuu Yamashita, Kanagawa (JP); Hiroyuki Abiru, Kanagawa (JP); Hiroo Kitagawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/724,465

(22) Filed: May 28, 2015

(65) Prior Publication Data

US 2015/0261167 A1 Sep. 17, 2015

Related U.S. Application Data

(63) Continuation of application No. 14/288,128, filed on May 27, 2014, now Pat. No. 9,069,319, which is a continuation of application No. 13/422,775, filed on Mar. 16, 2012, now Pat. No. 8,768,232.

(30) Foreign Application Priority Data

Mar. 18, 2011 (JP) ..... 2011-061572
Mar. 13, 2012 (JP) ..... 2012-056470

(51) Int. Cl.
*G03G 15/20* (2006.01)
*G03G 15/00* (2006.01)

(52) U.S. Cl.
CPC ..... *G03G 15/6585* (2013.01); *G03G 15/2021* (2013.01); *G03G 2215/0081* (2013.01); *G03G 2215/00805* (2013.01)

(58) Field of Classification Search
CPC ..... G03G 15/2021; G03G 15/6582; G03G 15/6585; G03G 2215/00805; G03G 2215/0081
USPC ..... 399/39, 40, 82, 341, 342
See application file for complete search history.

(56) References Cited

U.S. PATENT DOCUMENTS

| | | | |
|---|---|---|---|
| 6,438,336 | B1 | 8/2002 | Bengtson |
| 7,024,149 | B2 | 4/2006 | Kito et al. |
| 7,139,521 | B2 | 11/2006 | Ng et al. |
| 7,877,053 | B2 | 1/2011 | Ng et al. |
| 8,417,135 | B2 | 4/2013 | Mestha et al. |
| 8,531,724 | B2 | 9/2013 | Linuma |
| 8,634,753 | B2 | 1/2014 | Omata |
| 8,768,232 | B2 | 7/2014 | Yamamoto et al. |
| 9,069,319 | B2 * | 6/2015 | Yamamoto et al. ..... G03G 15/6585 399/341 |

FOREIGN PATENT DOCUMENTS

| | | |
|---|---|---|
| JP | 3473588 | 9/2003 |
| JP | 2007-34040 | 2/2007 |
| JP | 2007-189318 | 7/2007 |

* cited by examiner

*Primary Examiner* — William J Royer
(74) *Attorney, Agent, or Firm* — Oblon, McClelland, Maier & Neustadt, L.L.P

(57) ABSTRACT

An information processing apparatus is connected to a print control apparatus for generating image data. The information processing apparatus includes a generating unit configured to generate gloss control plate data for specifying a type of a surface effect imparted to a recording medium and a region in the recording medium to which the surface effect is imparted; and a transmitting unit configured to transmit the gloss control plate data to the print control apparatus.

18 Claims, 21 Drawing Sheets

| GLOSS CONTROL NAME | GLOSS | DEVIATION |
|---|---|---|
| PREMIUM GLOSS (PG) | Gs≥80 | ΔGs≤10 |
| GLOSS (G) | Gs=Gs (SOLID GLOSS) | ΔGs≤10 |
| MATTE (M) | Gs=Gs (1C WITH 30% HALFTONE) | ΔGs≤10 |
| PREMIUM MATTE (PM) | Gs≤10 | ΔGs≤10 |

| TYPE OF SURFACE EFFECT DESIGNATED BY USER | DENSITY VALUE OF GLOSS CONTROL PLATE [%] |
|---|---|
| PG | 98% |
| G | 90% |
| M | 16% |
| PM | 6% |

| RENDERING OBJECT | COORDINATE | DENSITY VALUE |
|---|---|---|
| A, B, C | (x1, y1)-(x2, y2) | 98% |
| (SQUARE) | (x3, y3)-(x4, y4) | 90% |
| ... | ... | ... |

FIG.18

| DENSITY [%] | DENSITY | | | EFFECT | GLOSSER ON/OFF (ON/OFF INFORMATION) | CLEAR TONER PLATE 1 (PRINTER MACHINE) | CLEAR TONER PLATE 2 (LOW-TEMPERATURE FIXING UNIT) |
|---|---|---|---|---|---|---|---|
| | REPRESENTATIVE VALUE | VALUE RANGE | | | | | |
| 98 % | 250 | 248 | 255 | PREMIUM GLOSS, TYPE A | ON | INVERSE MASK A | NO DATA |
| 96 % | 245 | 243 | 247 | PREMIUM GLOSS, TYPE B | ON | INVERSE MASK B | NO DATA |
| 94 % | 240 | 238 | 242 | PREMIUM GLOSS, TYPE C | ON | INVERSE MASK C | NO DATA |
| 92 % | 235 | 233 | 237 | RESERVED | | | |
| 90 % | 230 | 228 | 232 | GLOSS, TYPE 1 | OFF | INVERSE MASK 1 | NO DATA |
| 88 % | 224 | 222 | 227 | GLOSS, TYPE 2 | OFF | INVERSE MASK 2 | NO DATA |
| 86 % | 219 | 217 | 221 | GLOSS, TYPE 3 | OFF | INVERSE MASK 3 | NO DATA |
| 84 % | 214 | 212 | 216 | GLOSS, TYPE 4 | OFF | INVERSE MASK 4 | NO DATA |
| 82 % | 209 | 207 | 211 | RESERVED | | | |
| 46 % | 117 | 115 | 119 | RESERVED | | | |
| 44 % | 112 | 110 | 114 | WATERMARK CHARACTER 3 (XXX) | OFF | NO DATA | TILE STRING 3 |
| 42 % | 107 | 105 | 109 | WATERMARK CHARACTER 2 (COPY PROHIBITED) | | NO DATA | TILE STRING 2 |
| 40 % | 102 | 100 | 104 | WATERMARK CHARACTER 1 (SAMPLE) | | NO DATA | TILE STRING 1 |
| 38 % | 97 | 95 | 99 | RESERVED | | | |
| 36 % | 92 | 90 | 94 | RESERVED | | | |
| 34 % | 87 | 85 | 89 | WOVEN PATTERN 3 (XXX) | | NO DATA | TILE WOVEN PATTERN 3 |
| 32 % | 82 | 80 | 84 | WOVEN PATTERN 2 (LATTICE) | | NO DATA | TILE WOVEN PATTERN 2 |
| 30 % | 76 | 74 | 79 | WOVEN PATTERN 1 (WAVE) | | NO DATA | TILE WOVEN PATTERN 1 |
| 28 % | 71 | 69 | 73 | RESERVED | | | |
| 26 % | 66 | 64 | 68 | RESERVED | | | |
| 24 % | 61 | 59 | 63 | TACTUAL PATTERN, TYPE 3 (ROUGH) | | NO DATA | TILE MESH PATTERN 3 |
| 22 % | 56 | 54 | 58 | TACTUAL PATTERN, TYPE 2 (MODERATE) | | NO DATA | TILE MESH PATTERN 2 |
| 20 % | 51 | 49 | 53 | TACTUAL PATTERN, TYPE 1 (FINE) | | NO DATA | TILE MESH PATTERN 1 |
| 18 % | 46 | 44 | 48 | RESERVED | | | |
| 16 % | 41 | 39 | 43 | MATT, TYPE 4 | OFF | HALFTONE 4 | NO DATA |
| 14 % | 36 | 34 | 38 | MATT, TYPE 3 | OFF | HALFTONE 3 | NO DATA |
| 12 % | 31 | 29 | 33 | MATT, TYPE 2 | OFF | HALFTONE 2 | NO DATA |
| 10 % | 25 | 23 | 28 | MATT, TYPE 1 | OFF | HALFTONE 1 | NO DATA |
| 8 % | 20 | 18 | 22 | RESERVED | | | |
| 6 % | 15 | 13 | 17 | PREMIUM MATT, TYPE C | ON&OFF | NO DATA | SOLID |
| 4 % | 10 | 8 | 12 | PREMIUM MATT, TYPE B | ON&OFF | NO DATA | SOLID |
| 2 % | 5 | 1 | 7 | PREMIUM MATT, TYPE A | ON&OFF | NO DATA | SOLID |
| 0 % | 0 | 0 | 0 | NONE | OFF | NO DATA | NO DATA |

INFORMATION PROCESSING APPARATUS, METHOD, AND STORAGE MEDIUM FOR GENERATING IMAGE DATA SPECIFYING A TYPE OF SURFACE EFFECT

CROSS-REFERENCE TO RELATED APPLICATIONS

The present continuation application claims priority to [and incorporates by reference the entire contents of] application Ser. No. 14/288,128, filed on May 27, 2014, which is a continuation of application Ser. No. 13/422,775, filed Mar. 16, 2012, and claims priority to [and incorporates by reference the entire contents of each of] Japanese Patent Application No. 2011-061572 filed on Mar. 18, 2011, and Japanese Patent Application No. 2012-056470 filed on Mar. 13, 2012. The entire contents of each of the above-listed documents is hereby incorporated by reference

BACKGROUND OF THE INVENTION

1. Field of the Invention

The present invention relates to an information processing apparatus, an image forming system, and a computer program product.

2. Description of the Related Art

In the past, there is an image forming apparatus that stores a clear toner, which is a colorless toner not containing a color material, besides toners of four colors CMYK. A toner image formed with such a clear toner is fixed on a recording medium such as paper on which images are formed with the toners of CMYK. As a result, a visual effect or a tactual effect on the surface of the recording medium (referred to as surface effects) is realized. Surface effects to be realized are different depending on what type of toner image is formed with the clear toner and how the toner image is fixed. Some surface effects simply impart a gloss and other surface effects suppress a gloss. It is desired to impart a surface effect to only a part of the surface rather than to the entire surface. There is also a demand for a surface effect for forming a texture or a watermark with the clear toner. In some case, surface protection is demanded. There is also a surface effect that can be realized by performing post-processing with a dedicated post-processor such as a glosser or a low-temperature fixing unit besides fixing control. In recent years, for example, as disclosed in Japanese Patent No. 3473588, a technology for depositing the clear toner only on a desired section in a part of the surface to impart a gloss is developed.

As disclosed in Japanese Patent Application Laid-Open No. 2007-034040, the gloss is affected by surface roughness of the image formed on the recording medium. In other words, the gloss is affected by irregularity of the surface of the recording medium caused by the toners of CMYK. Therefore, a degree of the gloss does not simply increase according to the density of the clear toner.

To impart a gloss, it is necessary to control the smoothness of the surface of an image. Therefore, it is necessary to create, according to density values of CMYK concerning pixels on which the clear toner is deposited and presence or absence and a type of a post-processing apparatus connected to an image forming apparatus, image data of a clear toner plate (clear toner plane), which is image data for forming a toner image by the clear toner. It is necessary to finely adjust, for example, contents of the image data of the clear toner plate, the number of the image data of the clear toner plate to be created, and control of a printer machine and control of the post-processor. It is difficult for a user to create image data and perform print setting for control taking into account the foregoing.

In the related art, one type of a surface effect such as Premium Gloss can be imparted to the entire surface of one page of a recording medium. However, it is difficult to impart a plurality of kinds of gloss in the one page of the recording medium.

Therefore, there is a need for an information processing apparatus, a printer driver program, and an image forming system that can impart, without causing a user trouble, a desired surface effect by a clear toner to a recording medium on which an image is formed and can apply a plurality of kinds of surface effects in one page in the recording medium.

SUMMARY OF THE INVENTION

It is an object of the present invention to at least partially solve the problems in the conventional technology.

According to an embodiment, there is provided an information processing apparatus that is connected to a print control apparatus for generating image data. The information processing apparatus includes a generating unit configured to generate gloss control plate data for specifying a type of a surface effect imparted to a recording medium and a region in the recording medium to which the surface effect is imparted; and a transmitting unit configured to transmit the gloss control plate data to the print control apparatus.

An information processing apparatus is connected to a print control apparatus for generating image data. The information processing apparatus includes a generating unit configured to generate gloss control plate data for specifying a type of a surface effect imparted to a recording medium and a region in the recording medium to which the surface effect is imparted; and a transmitting unit configured to transmit the gloss control plate data to the print control apparatus.

According to another embodiment, there is provided an image forming system that includes a print control apparatus configured to generate image data; an information processing apparatus connected to the print control apparatus; a generating unit configured to generate gloss control plate data for specifying a type of a surface effect imparted to a recording medium and a region in the recording medium to which the surface effect is imparted; and a clear-toner-plate generating unit configured to generate, based on the gloss control plate data, clear toner plate data corresponding to presence or absence of one or a plurality of post-processors connected to a printing apparatus and a type(s) of the post-processor(s).

According to still another embodiment, there is provided a computer program product comprising a non-transitory computer readable medium including programmed instructions, wherein the instructions, when executed by a computer connected to a print control apparatus for generating image data, cause the computer to execute generating gloss control plate data for specifying a type of a surface effect imparted to a recording medium and a region in the recording medium to which the surface effect is imparted; and transmitting the gloss control plate data to the print control apparatus.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 18 is a diagram of an example of a data structure of a surface effect selection table;

DETAILED DESCRIPTION OF THE PREFERRED EMBODIMENTS

Figure 1:
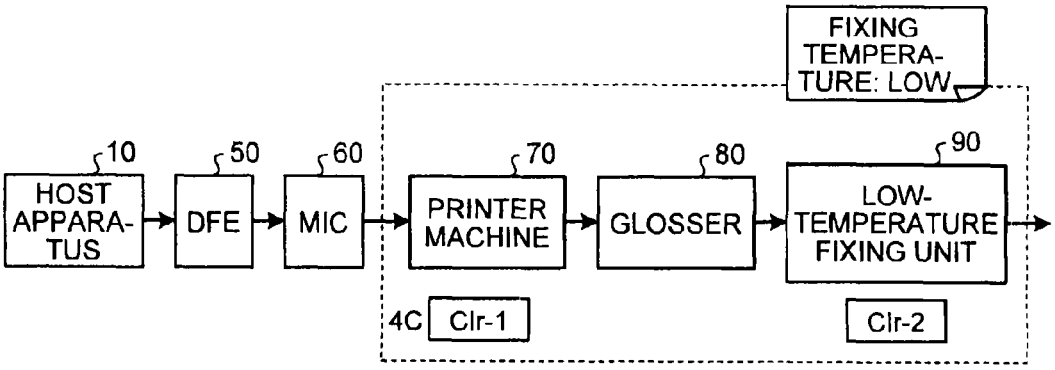
FIG. 1 is a diagram of an example of the configuration of an image forming system according to a first embodiment.

Exemplary embodiments of an image processing apparatus, a printer driver program, and an image forming system according to the present invention are explained in detail below with reference to the accompanying drawings.

First Embodiment

First, the configuration of an image forming system according to a first embodiment is explained below with reference to FIG. 1. In this embodiment, the image forming system is configured by connecting a print control apparatus (a digital front end (DFE)) 50 (hereinafter referred to as "DFE 50"), an interface controller (Mechanism I/F controller (MIC)) 60 (hereinafter referred to as "MIC 60"), a printer machine 70, and a glosser 80 and a low-temperature fixing unit 90 functioning as post processing machines. The DFE 50 communicates with the printer machine 70 via the MIC 60 and controls image formation in the printer machine 70. A host apparatus 10 (information processing apparatus) such as a personal computer (PC) is connected to the DFE 50. The DFE 50 receives image data from the host apparatus 10, generates, using the received image data, image data for the printer machine 70 to form toner images corresponding to toners of CMYK and a clear toner, and transmits the image data to the printer machine 70 via the MIC 60. The printer machine 70 stores at least the toners of CMYK and the clear toner. The printer machine 70 includes image forming units including photosensitive elements, charging devices, developing devices, and photosensitive-member cleaners for the respective toners, an exposing device, and a fixing unit.

The clear toner is a transparent (colorless) toner not containing a color material. "Transparent (colorless)" indicates that, for example, transmittance is equal to or higher than 70%.

The printer machine 70 emits a light beam from the exposing device to form toner images corresponding to the toners on the photosensitive elements according to the image data transmitted from the DFE 50 via the MIC 60. The printer machine 70 transfers the toner images onto paper serving as a recording medium and causes the fixing unit to fix the toner images on the paper through heating and pressing at a temperature in a predetermined range (a normal temperature). Consequently, an image is formed on the paper. Such a configuration of the printer machine 70 is widely known. Therefore, detailed explanation of the configuration is omitted. The paper is an example of a recording medium. In other words, the recording medium is not limited to paper. For example, the recording medium includes synthesized paper, vinyl paper, and the like.

The glosser 80 is controlled to be turned on or off according to on/off information designated by the DFE 50. When turned on, the glosser 80 presses, at high temperature and high pressure, an image formed on paper by the printer machine 70 and, thereafter, cools the paper and separates the paper having the image formed thereon from the main body of the glosser 80. Consequently, a total despot amount of toners of pixels on which the toners equal to or larger than a predetermined amount are deposited is uniformly compressed over the entire image formed on the paper. The low-temperature fixing unit 90 is mounted with an image forming unit including a photosensitive element, a charging device, a developing device, and a photosensitive-member cleaner for a clear toner, an exposing device, and a fixing unit for fixing the clear toner. The low-temperature fixing unit 90 receives image data of a clear toner plate explained below generated by the DFE 50 for use by the low-temperature fixing unit 90. When the DFE 50 generates the image data of the clear toner plate ("clear toner plate image data") to be used by the low-temperature fixing unit 90, the low-temperature fixing unit 90 generates a toner image by the clear toner using the image data, superimposes the toner image on the paper pressed by the glosser 80, and causes the fixing unit to fix the toner image on the paper through heating or pressing lower than usual.

Image data (document data) input from the host apparatus 10 is explained below. The host apparatus 10 generates image data according to a pre-installed image processing application (a plate-data generating unit 122, a print-data generating unit 123, or the like explained below with reference to FIG. 7) and transmits the image data to the DFE 50. Such an image processing application can handle image data of a special color plate with respect to image data in which values of densities ("density values") of colors in RGB plates (RGB planes) and color plates such as CMYK are specified for each pixel. The special color plate means image data for depositing a special toner or ink of white, gold, silver, or the like in addition to basic colors such as CMYK or RGB. The special color plate is data for a printer mounted with such a special toner or ink. The special color plate is sometimes used for adding red (R) to the basic colors of CMYK or adding yellow (Y) to the basic colors of RGB to improve color reproducibility. Usually, the clear toner is also handled as one of the special colors.

In this embodiment, the clear toner serving as the special color is used for forming a surface effect, which is a visual or tactual effect imparted to paper, and to form, on the paper, a transparent image such as a watermark or a texture other than the above surface effect.

Therefore, the image processing application of the host apparatus 10 generates, with respect to input image data, according to designation by a user, any one of image data of a gloss control plate (gloss control plane) and image data of a clear plate (clear plane) or both as image data of the special plate besides image data of a color plate.

Figure 2:
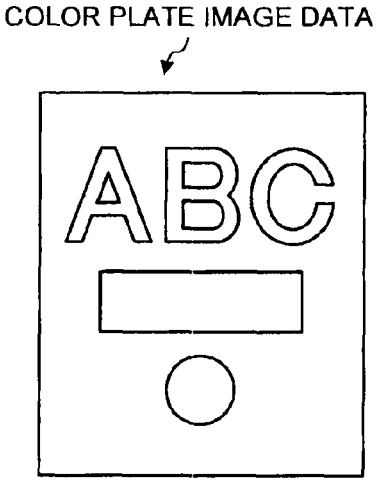
FIG. 2 is a diagram of an example of image data of a color plate.

The image data of the color plate (hereinafter, sometimes referred to as "color plate data") is image data in which density values of colors such as RGB or CMYK are specified for each pixel. In the image data of the color plate, one pixel is represented by 8 bits according to designation of a color by the user. FIG. 2 is a diagram for explaining an example of the image data of the color plate. In FIG. 2, a density value corresponding to a color designated by the user with the image processing application is given to each of rendering objects such as "A", "B", and "C".

The image data of the gloss control plate is image data in which a region to which a surface effect is imparted and a type of the surface effect are specified to perform control for depositing the clear toner corresponding to the surface effect, which is a visual or a tactual effect, imparted to paper.

The image data of the gloss control plate is represented by a density value in a range of "0" to "255" in 8 bits for each pixel in the same manner as the color plates of RGB, CMYK, and the like. A type of the surface effect is associated with the density value (the density value can be represented by 16 bits or 32 bits or 0% to 100%). The same value is set to a range, to which the same surface effect is desired to be imparted, regardless of the density of the clear toner actually imparted. Therefore, when necessary, it is possible to easily specify a region from the image data even without data that indicates the region. In other words, the image data of the gloss control plate represents the type of the surface effect and the region to which the surface effect is imparted (data indicating the region can be separately imparted).

The host apparatus 10 sets a type of a surface effect for a rendering object, which is designated by the user using the image processing application, as a density value serving a gloss control value for each rendering object and generates image data of the gloss control plate (hereinafter, sometimes referred to as "gloss control plate data") of the vector format.

Pixels included in the image data of the gloss control plate corresponds to pixels of the image data of the color plate. In the image data, density values represented by the pixels are pixel values. Both of the image data of the color plate and the image data of the gloss control plate are formed in a page unit.

Figures 3, 4:
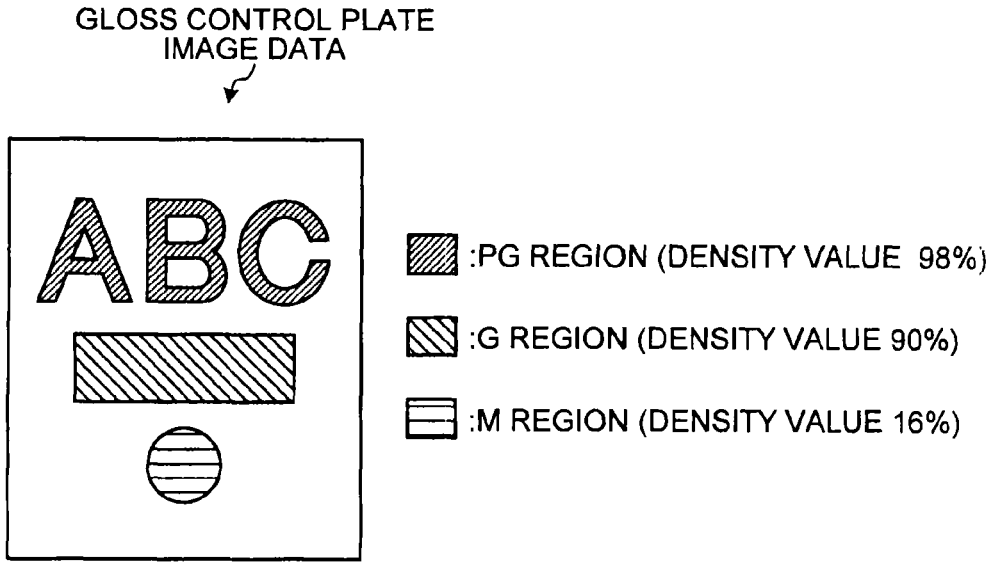
FIG. 3 is diagram of an example of types of surface effects concerning presence or absence of a gloss.
FIG. 4 is a diagram of image data of a gloss control plate.

As types of surface effects, there are roughly types concerning presence or absence of gloss, surface protection, a watermark embedded with information, and a texture. As surface effects concerning presence or absence of a gloss, there are roughly four types as shown in FIG. 3 as an example, i.e., Premium Gloss (mirror glossy); Gloss (solid glossy); Matte (halftone matte); and Premium Matte (delustered) in order from the surface effect having the highest degree of a gloss (glossiness). In the following explanation, in some case, the Premium Gloss is referred to as "PG", the Gloss is referred to as "G", the Matte is referred to as "M", and the Premium Matte is referred to as "PM".

The Premium Gloss and the Gloss have a high degree of giving a gloss. Conversely, the Matte and the Premium Matte are surface effects for reducing a gloss. In particular, the Premium Matte is a surface effect for realizing glossiness lower than the glossiness of usual paper. In the figure, the Premium Gloss indicates glossiness Gs equal to or higher than 80, the Gloss indicates the Glossiness of a primary color or a secondary color, the Matte indicates the glossiness of a primary color with 30% of halftone dots, and the Premium Matte indicates the glossiness equal to or lower than 10. The deviation of the glossiness is represented by $\Delta Gs$ and set to be equal to or smaller than 10. With respect to such types of the surface effects, high density values are associated with the surface effects that have high degrees of imparting a gloss. Low density values are associated with the surface effects that suppress a gloss. Intermediate density values are associated with the surface effects such as the watermark and the texture. As the watermark, for example, a character or a woven pattern is used. The texture represents a character or a pattern and can impart a tactual effect besides a visual effect. For example, a stained glass pattern can be realized by the clear toner. The surface protection is substituted by the Premium Gloss or the Gloss. The user designates according to the image processing application to which region of an image represented by processing target image data a surface effect is imparted and which type of a surface effect is imparted to the region. The host apparatus 10 that executes the image processing application generates, concerning a rendering object included in the region designated by the user, image data of the gloss control plate by setting a density value corresponding to the surface effect designated by the user. A correspondence relation between the density value and the type of the surface effect is explained below.

FIG. 4 is a diagram for explaining an example of image data of the gloss control plate. The example of the image data of the gloss control plate shown in FIG. 4 indicates an example in which the surface effect "PG (Premium Gloss)" is imparted to a rendering object "ABC", the surface effect "G (Gloss)" is imparted to a rendering object "(rectangular figure)", and the surface effect "M (Matte)" is imparted to a rendering object "(circular figure)". Density values set for surface effects are density values set to correspond to types of surface effects in a density value selection table explained below (see FIG. 9).

Figure 5:
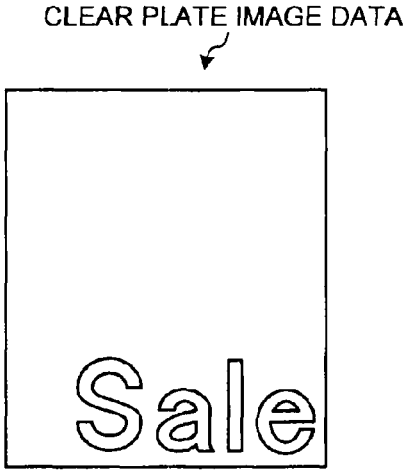
FIG. 5 is a diagram of an example of image data of a clear plate.

The image data of the clear plate is image data in which a transparent image such as a watermark or a texture other than the surface effects is specified. FIG. 5 is a diagram for explaining an example of the image data of the clear plate. In the example shown in FIG. 5, a watermark "Sale" is specified by the user.

As explained above, the image data of the gloss control plate and the image data of the clear plate, which are the image data of the special color plate, are generated by the image processing application of the host apparatus 10 in a plate (plane) separated from that of the image data of the color plate. A Portable Document Format (PDF) is used as a format of the image data of the color plate, the image data of the gloss control plate, and the image data of the clear plate. However, the image data of the PDF of the plates are integrated and generated as document data. The data format of the image data of the plates is not limited to the PDF and an arbitrary format can be used.

Figure 6:
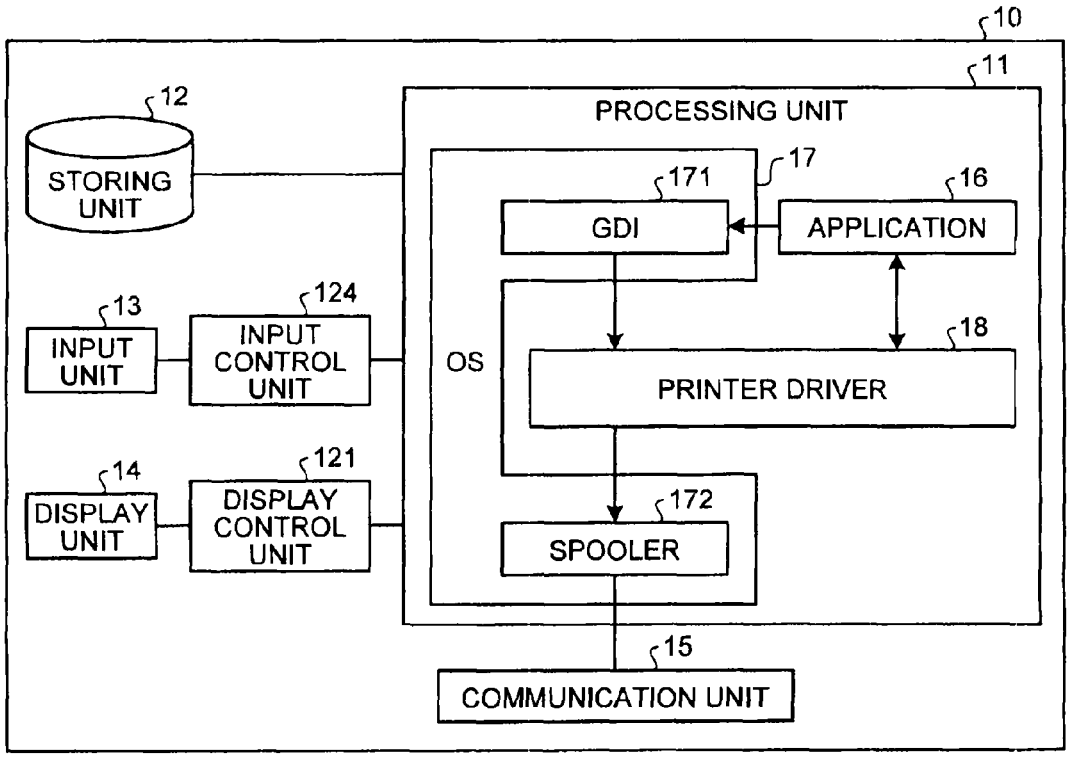
FIG. 6 is a block diagram of a schematic configuration example of a host apparatus.

Details of the host apparatus 10 that generates image data of such plates are explained below. FIG. 6 is a block diagram of a schematic configuration example of the host apparatus 10.

The host apparatus 10 includes, as shown in FIG. 6, a processing unit 11, a storing unit 12, an input unit 13, a display unit 14, an input control unit 124, a display control unit 121, and a communication unit 15. The processing unit 11 includes a central processing unit (CPU) and a memory group including a ROM and a RAM functioning as a main memory, which are not shown in the figure. During start and execution of the host apparatus 10, an application 16, an OS 17, and various drivers (in FIG. 6, only a printer driver 18 is shown) are loaded from the ROM and the storing unit 12 onto the main memory and expanded. The application 16, the OS 17, and the various drivers are executed by the CPU.

The storing unit 12 is storing means for storing various kinds of information and is specifically a hard disk drive (HDD) or the like. Information to be stored includes information concerning processing for realizing functions of the printer driver 18 (e.g., a setting value used for the processing, display information and the like for changing the setting value, and information necessary for the processing).

The input unit 13 is an input device such as a keyboard or a mouse. The input unit 13 outputs contents of operation by the user to the processing unit 11. The display unit 14 is a display device such as a display and displays predetermined information (e.g., a user interface (UI)) according to the control by the processing unit 11. The communication unit 15 is a network I/F that performs transmission and reception of information to and from the DFE 50 connected via a network.

The input control unit 124 receives various inputs from the input unit 13 and controls the inputs. For example, the user can input, by operating the input unit 13, image designation information for designating an image to which a surface effect should be imparted, i.e., image data of the color plate (hereinafter, in some case, also referred to as "target image") among various images (e.g., a photograph, a character, a figure, or an image obtained by combining the photograph, the character, and the figure) stored in the storing unit 12. This is not a limitation. A method of inputting image designation information is arbitrary.

The display control unit 121 controls display of various kinds of information on the display unit 14. In the embodiment, when the input control unit 124 receives image identification information, the display control unit 121 reads out an image designated by the image designation information from the storing unit 12 and controls the display unit 14 to display the read-out image on a screen.

The application 16 is software (e.g., word processor software) with which the user can instruct printing. When the user desires to print data edited by the application 16, the application 16 receives a printing instruction by the user. In this case, the application 16 passes printing target information (image data) to a graphics device interface (GDI) 171 of the OS 17 together with a printing request corresponding to the printing instruction according to, for example, a GDI call.

The OS 17 is a computer program for managing hardware and software of the host apparatus 10. The OS 17 performs start of a computer program, control of reading and storage of information, and the like. As representative ones of OSs, MS Windows (registered trademark) and the like are known. The GDI 171 of the OS 17 passes printing target information (text data, graphic data, image data, etc.) to the printer driver 18 according to a device driver interface (DDI) call together with the printing request including setting information passed from the application 16 according to the GDI call. The OS 17 stores print data generated by the printer driver 18 in a spooler 172, sequentially supplies the print data to the communication unit 15, and causes the communication unit 15 to transmit the print data to the DFE 50.

Figure 7:
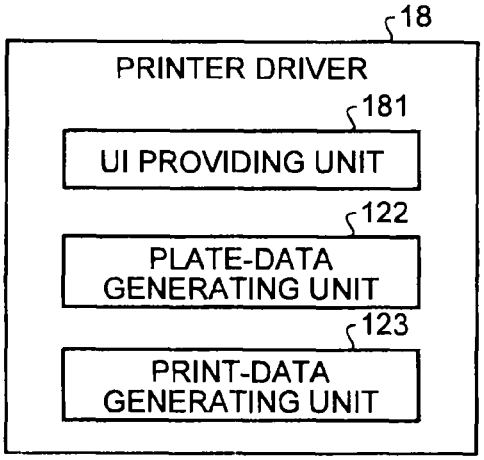
FIG. 7 is a diagram of an example of a functional configuration of a printer driver according to the first embodiment.

The printer driver 18 includes, as shown in FIG. 7, a UI providing unit 181, the plate-data generating unit 122, and the print-data generating unit 123 as a module group for playing functions of the driver.

Figure 8:
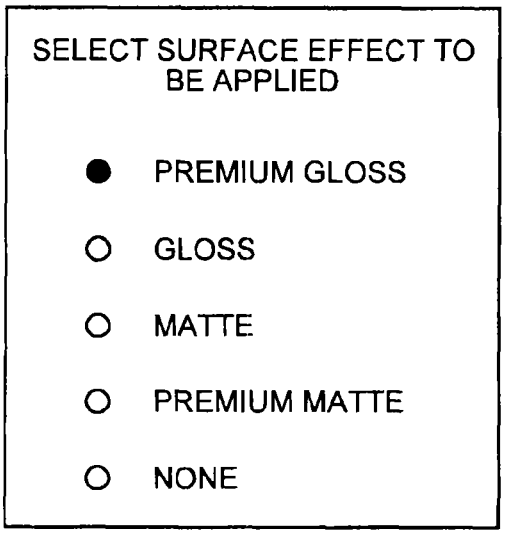
FIG. 8 is a diagram of an example of a user interface (UI) displayed by a UI providing unit.

The UI providing unit 181 cooperates with the OS 17 and causes the display unit 14 to display a UI for causing the user to input (select) various kinds of information related to image formation. Specifically, the UI providing unit 181 outputs a surface effect selection screen shown in FIG. 8 to the display unit 14 via the display control unit 121 as a UI for causing the user to select a type of a surface effect imparted to a sheet. As the type of the surface effect, for example, there is a type concerning presence or absence of gloss. As the surface effect concerning presence or absence of gloss, as shown in FIG. 8 as an example, there are roughly four types: Premium Gloss, Gloss, Matte, and Premium Matte in the order from the surface effect having the highest degree of a gloss (gloss degrees).

The plate-data generating unit 122 generates image data of the color plate, image data of the gloss control plate, and image data of the clear toner plate. When the input control unit 124 receives color designation by the user concerning a rendering object of a target image, the plate-data generating unit 122 generates image data of the color plate according to the color designation.

When the input control unit 124 receives designation of a transparent image such as a water mark or a texture other than a surface effect and a region to which the transparent image is given, the plate-data generating unit 122 generates, according to the designation from the user, clear data for designating the transparent image and a region on paper to which the transparent image is imparted.

When the input control unit 124 receives designation information (a region to which a surface effect is imparted and a type of the surface effect), the plate-data generating unit 122 generates, based on the designation information, image data of the gloss control plate that can designate the region to which the surface effect is imparted on the paper and the type of the surface effect. The plate-data generating unit 122 generates image data of the gloss control plate in which a region to which a surface effect indicated by a gloss control value is imparted is designated in a unit of a rendering object of image data of a target image.

Figures 12, 13:
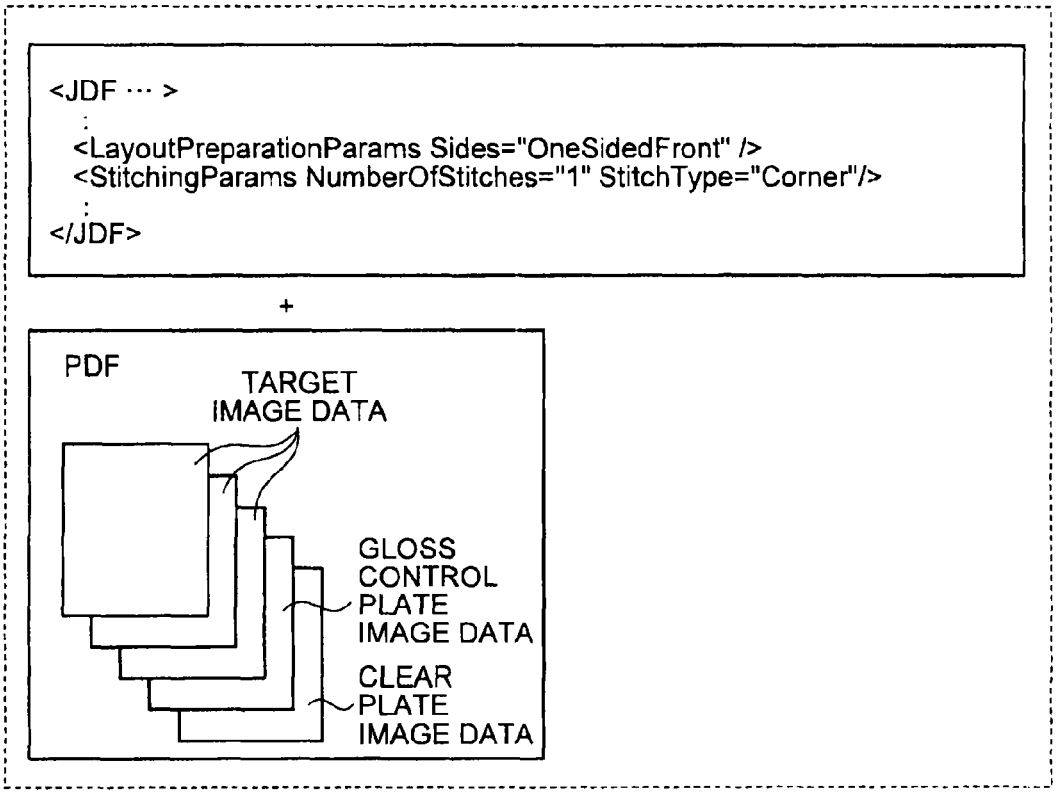
FIG. 12 is a diagram of an example of a density value selection table.
FIG. 13 is a schematic diagram of a configuration example of print data.

The storing unit 12 stores a density value selection table that stores a type of a surface effect designated by the user and a gloss control density value corresponding to the type of the surface effect. FIG. 12 is a diagram of an example of the density value selection table. In the example shown in FIG. 12, a gloss control density value corresponding to a region where "PG" (Premium Gloss) is designated is "98%", a gloss control density value corresponding to a region where "G" (Gloss) is designated is "90%", a gloss control density value corresponding to a region where "M" (Matte) is designated is "16%", and a gloss control density value corresponding to a region where "PM" (Premium Matte) is designated is "6%".

The density value selection table is data of a part of a surface effect selection table (explained later) stored in the DFE 50. The communication unit 15 acquires the surface effect selection table at predetermined timing, generates the density value selection table from the acquired surface effect selection table, and stores the density value selection table in the storing unit 12. The surface effect selection table can be stored in a storage server (cloud) on a network such as the Internet. The control unit 15 can acquire the surface effect selection table from the server and generates the density value selection table from the acquired surface effect selection table. However, the surface effect selection table stored in the DFE 50 and the surface effect selection table stored in the storing unit 12 need to be the same data.

Referring back to FIG. 7, the plate-data generating unit 122 sets, while referring to the density value selection table shown in FIG. 12, a density value (a gloss control value) of a rendering object, for which a predetermined surface effect is designated by the user, to a value corresponding to a type of the surface effect to generate image data of the gloss control plate. For example, it is assumed that the user designates to apply "PG" to a region displayed as "ABC", apply "G" to a rectangular region, and apply "M" to a circular region in a target image, which is the image data of the color plate. In this case, the plate-data generating unit 122 sets a density value of a rendering object ("ABC") for which "PG" is designated by the user to "98%", sets a density value of a rendering object ("rectangular") for which "G" is designated by the user to "90%", and sets a density value of a rendering object ("circular") for which "M" is designated by the user to "16%" to generate image data of the gloss control plate. The image data of the gloss control plate generated by the plate-data generating unit 122 is data of a vector format represented as aggregation of coordinates of points, parameters in formulas on lines or planes connecting the points, and rendering objects indicating painted portions or special effects. FIG. 4 is a diagram of an image of the image data of the gloss control plate shown as an image. The plate-data generating unit 122 generates document data obtained by combining the image data of the gloss control plate, the image data of the target image (the image data of the color plate), and the image data of the clear toner plate and passes the document data to the print-data generating unit 123.

The Premium Gloss and the Gloss are used for giving high level of gloss while the Matte and the Premium Matte are used for reducing gloss. In particular, the Premium Matte is used for realizing lower glossiness than the glossiness of a normal paper. For example, the Premium Gloss can be set to the glossiness Gs equal to or higher than 80, the Gloss can be set to the Glossiness of a primary color or a secondary color, the Matte can be set to the glossiness of a primary color with 30% of halftone dots, and the Premium Matte can be set to the glossiness Gs equal to or lower than 10.

Figure 10:
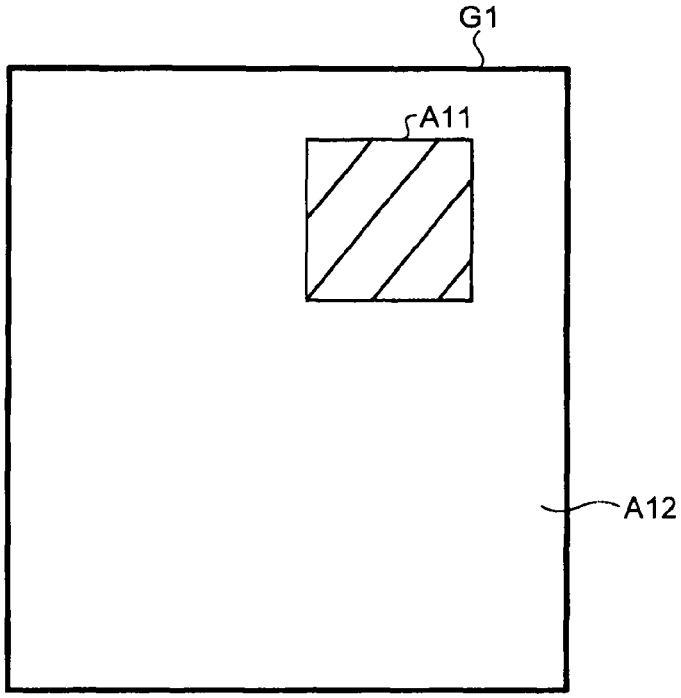
FIG. 10 is a diagram of an example of a method of setting a surface effect region in the image data.
Figure 11:
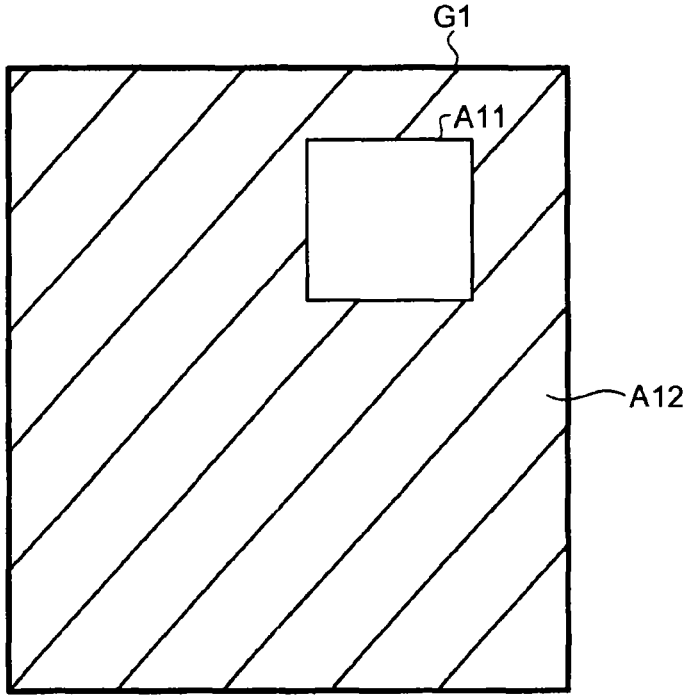
FIG. 11 is a diagram of another example of the method of setting a surface effect region in the image data.

An example of a method of setting a surface effect region corresponding to a data type is explained with reference to FIGS. 9, 10, and 11.

Figure 9:
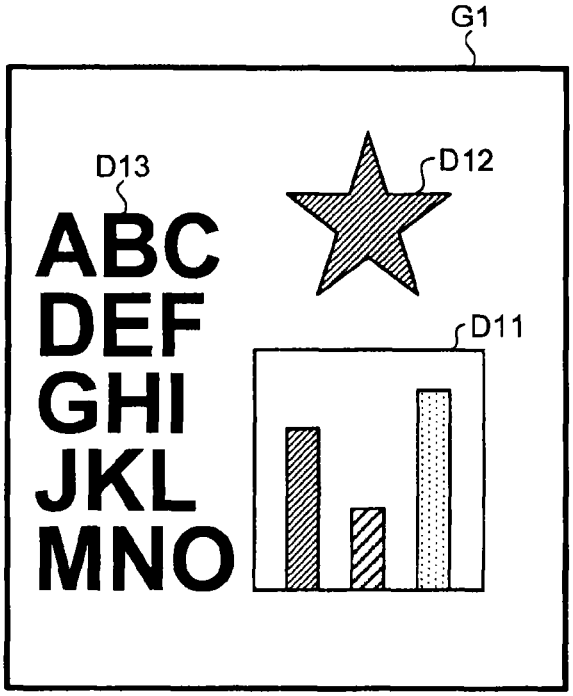
FIG. 9 is a diagram of an example of image data.

FIG. 9 is a diagram of an example of image data. Image data G1 includes graphic data D11 representing illustration or the like, image data D12 representing a photograph or the like, and text data D13 representing characters. When, for example, the "Premium Gloss" or the "Gloss" is selected on the surface effect selection screen provided by the UI providing unit 181, as shown in FIG. 10, the plate-data generating unit 122 sets, as a surface effect region, a region A11 where the image data D12 is arranged. When, for example, when the "Matte" or the "Premium Matte" is selected, as shown in FIG. 11, the plate-data generating unit 122 sets, as the surface effect region, a region A12 other than the region A11 where the image data D12 is arranged. In FIGS. 10 and 11, the region A11 is rectangular. However, the shape of the region A11 is not limited to the rectangular shape and can be a shape corresponding to the image data D12. The setting of a surface effect region corresponding to a surface effect is not limited to this example. These surface effect regions are determined depending on the surface effects in advance as illustrated in FIGS. 10 and 11. Alternatively, a given application may identify an object in the image data and set a surface effect region including the identified object depending on a surface effect.

Referring back to FIG. 7, the plate-data generating unit 122 acquires, referring to the density value selection table (FIG. 12), a density value corresponding to the surface effect selected on the surface effect selection screen from the density value selection table. As explained later, surface effects and density values (pixel values) corresponding to the surface effects are associated with each other in the density value selection table. The plate-data generating unit 122 reads out a density value associated with the selected surface effect from the density value selection table.

The plate-data generating unit 122 generates image data of the gloss control plate in which density values acquired from the density value selection table are set as pixel values in pixels forming the set surface effect region. The image data of the gloss control plate (hereinafter simply referred to as "gloss control plate" in some case) is image data for performing control for depositing the clear toner corresponding to a surface effect. The image data of the gloss control plate is represented by a density value in a range of 8 bits for each pixel in the same manner as the color plates of CMYK. The density values set in the pixels in the image data of the gloss control plate are pixel values. Both the color plates of CMYK and the gloss control plates are formed in a page unit of the same size as the image data.

The print-data generating unit 123 generates print data based on document data. The print data includes image data (image data of the color plate) of a target image, image data of the gloss control plate, image data of the clear toner plate, and a job command for designating, to the printer, for example, printer setting, aggregation setting, or setting of duplex and simplex printing. FIG. 13 is a schematic diagram of a configuration example of the print data. In the example shown FIG. 13, Job Definition Format (JDF) is used as the job command. However, this is not a limitation. The JDF shown in FIG. 13 is a command for designating "simplex printing and stapling" as the aggregation setting. The print data can be converted into page description language (PDL) such as PostScript or can be maintained in the PDF format if the DFE 50 is adapted to the PDF format.

The printer driver 18 transmits the print data generated by the print-data generating unit 123 to the DFE 50 via the communication unit 15. Color plates and gloss control plates of CMYK included in the print data can be generated as, for example, bitmap images or can be generated as other image formats (e.g., TIFF, JPEG, and GIF).

Figure 14:
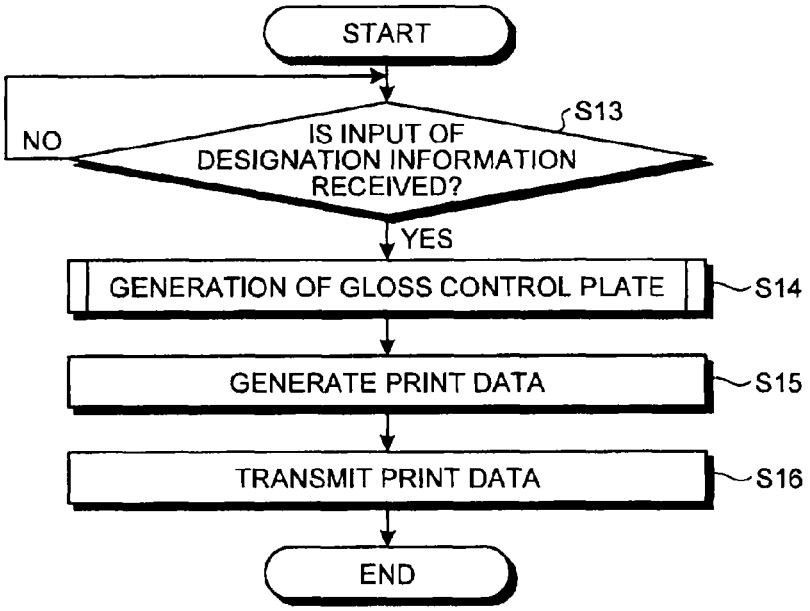
FIG. 14 is a flowchart for explaining a procedure of processing for generating print data by the host apparatus according to the first embodiment.

Processing for generating print data by the host apparatus 10 configured as explained above is explained. FIG. 14 is a flowchart for explaining a procedure of the processing for generating print data by the host apparatus 10 according to the first embodiment.

First, when the input control unit 124 receives the input of designation information of a surface effect for a target image from the surface effect selection screen shown in FIG. 8 (Yes at step S13), the plate-data generating unit 122 generates image data of the gloss control plate based on the received designation information (step S14).

Figure 15:
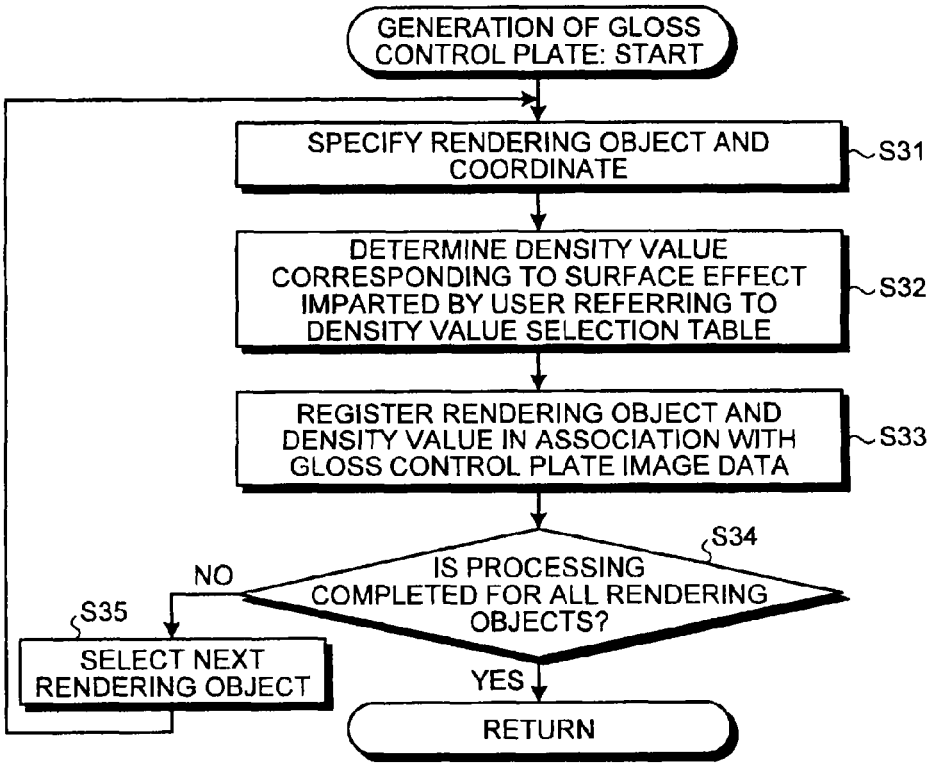
FIG. 15 is a flowchart for explaining a procedure of processing for generating a gloss control plate.

Details of the processing for generating gloss-plate image data at step S14 are explained. FIG. 15 is a flowchart for explaining a procedure of the processing for generating gloss-plate image data. First, the plate-data generating unit 122 designates a rendering object, which belongs to a region (e.g., the region of A11 shown in FIG. 10) set in advance for a display effect designated for a target image according to the designation information, and a coordinate of the rendering object (step S31). The rendering object included in the region and the coordinate are specified using, for example, a rendering command, which is provided by an operating system or the like for the rendering object in the target image, and a coordinate value set by the rendering command.

Subsequently, the plate-data generating unit 122 determines, referring to the density-value selection table stored in the storing unit 12, a density value serving as a gloss control value corresponding to the surface effect imparted by the user by the designation information (step S32).

The plate-data generating unit 122 registers, in image data of the gloss control plate (initially blank data), the rendering object and the density value, which is determined to correspond to the surface effect, in association with each other (step S33).

The plate-data generating unit 122 determines whether the processing from step S31 to step S33 is completed for all rendering objects present in the target image (step S34). When the processing is not completed for any of the rendering objects (No at step S34), the plate-data generating unit 122 selects the next unprocessed rendering object in the target image (step S35) and repeatedly executes the processing from step S31 to step S33.

Figures 16, 17:
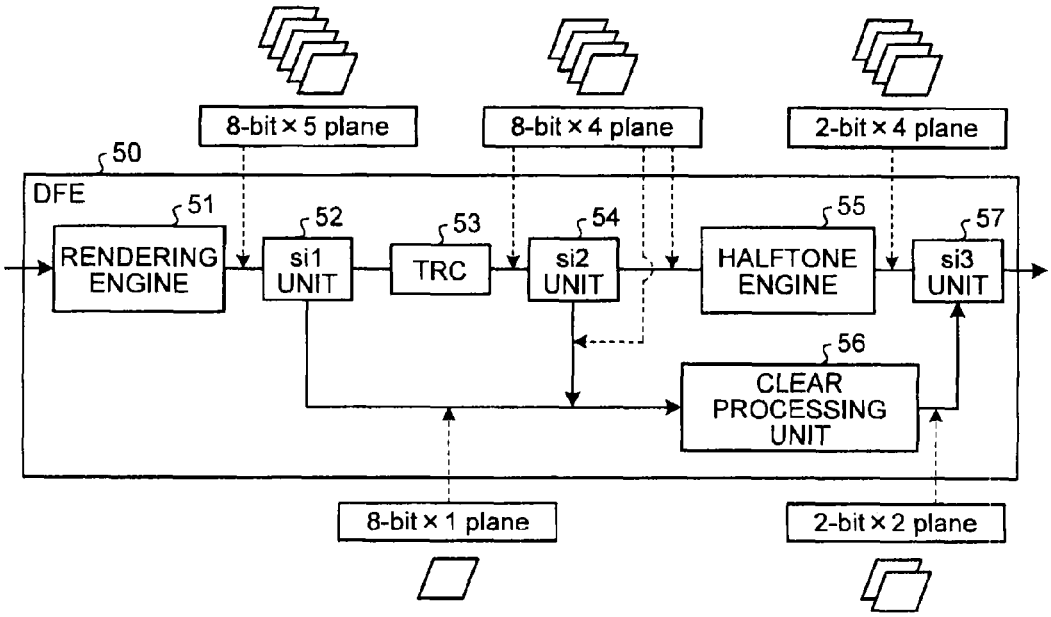
FIG. 16 is a diagram of a correspondence relation among a rendering object, a coordinate, and a density value in the image data of the gloss control plate shown in FIG. 4.
FIG. 17 is a diagram of an example of a functional configuration of a digital front end (DFE)

When it is determined at step S34 that the processing from step S31 to step S33 is completed for all the rendering objects in the target image (Yes at step S34), the plate-data generating unit 122 completes the generation of image data of the gloss control plate. As a result, the image data of the gloss control plate shown in FIG. 4 is generated. FIG. 16 is a diagram of a correspondence relation among the rendering object, the coordinate, and the density value in the image data of the gloss control plate shown in FIG. 4.

Referring back to FIG. 14, when the image data of the gloss control plate is generated, the plate-data generating unit 122 generates document data obtained by integrating the image data of the gloss control plate and the image data of the color plate of the target image and passes the document data to the print-data generating unit 123. The print-data generating unit 123 generates print data based on the document data (step S15). When a transparent image is designated, image data of the clear toner plate is also generated and included in the document data and print data is generated. Consequently, the print data is generated. The communication unit 15 transmits the generated print data to the DFE 50 (step S16).

A functional configuration of the DFE 50 is explained below. As shown in FIG. 17 as an example, the DFE 50 includes a rendering engine 51, an si1 unit 52, a tone reproduction curve (TRC) 53, an si2 unit 54, a halftone engine 55, a clear processing unit 56, an si3 unit 57, and the surface effect selection table (not shown). The rendering engine 51, the si1 unit 52, the TRC 53, the si2 unit 54, the halftone engine 55, the clear processing unit 56, and the si3 unit 57 are realized by a control unit of the DFE 50 executing various kinds of computer programs stored in a main storage unit or an auxiliary storage unit. A11 of the si1 unit 52, the si2 unit 54, and the si3 unit 57 have functions of separating image data and integrating image data. The surface effect selection table is stored in, for example, the auxiliary storage unit.

The rendering engine 51 receives input of the image data (for example, print data shown in FIG. 13) transmitted from the host apparatus 10. The rendering engine 51 subjects the input image data to language interpretation, converts the image data represented by the vector format into image data represented by the raster format, converts a color space represented by an RGB format or the like into a color space represented by a CMYK format, and outputs 8-bit image data of respective CMYK plates and 8-bit image data of a gloss control plate. The si1 unit 52 outputs the 8-bit color plate image data of each of CMYK to the TRC 53 and outputs the 8-bit gloss control plate image data to the clear processing unit 56. The DFE 50 converts the image data of the gloss control plate in the vector format output from the host apparatus 10 into image data in the raster format. As a result, the DFE 50 outputs the image data of the gloss control plate in which the type of the surface effect imparted to the rendering object designated by the user according to the image processing application is set as a density value with a pixel set as a unit.

The TRC 53 receives the 8-bit color plate image data of each of CMYK via the si1 unit 52. The TRC 53 applies gamma correction to the input image data using a gamma curve of a one-dimensional lookup table (1D_LUT) generated by calibration. Image processing includes total toner amount control and the like other than the gamma correction. The total amount control is processing for limiting the 8-bit color plate image data of each of CMYK subjected to the gamma correction because there is a limit in a toner amount that can be put on a recording medium in the printer machine 70 in one pixel on the recording medium. If printing is performed exceeding the total amount control, image quality is deteriorated by a transfer failure and a fixing failure. In this embodiment, only related gamma correction is explained as an example. The si2 unit 54 outputs the 8-bit color plate image data of each of CMYK, to which the gamma correction is applied by the TRC 53, to the clear processing unit 56 as data for generating an inverse mask (explained below). The halftone engine 55 receives, via the si2 unit 54, the 8-bit color plate image data of each of CMYK subjected to the gamma correction. The halftone engine 55 performs halftone processing for converting the input image data into a data format of image data of the color plate such as 2-bit color plate image data each of CMYK for output to the printer machine 70 and outputs the image data of the color plate such as 2-bit color plate image data of each of CMYK subjected to the halftone processing. The 2-bit image data are described by way of example and the number of bits is not limited thereto.

The clear processing unit 56 receives, via the si1 unit 52, the 8-bit gloss control plate image data converted by the rendering engine 51 and also receives, via the si2 unit 54, the 8-bit color plate image data of each of CMYK subjected to the gamma correction by the TRC 53. The clear processing unit 56 determines, using the input image data of the gloss control plate and referring to the surface effect selection table explained below, a surface effect corresponding to density values (pixel values) of pixels included in the image data of the gloss control plate and determines on or off of the glosser 80 according to the determination of the surface effect. The clear processing unit 56 generates an inverse mask or a solid mask as appropriate using the input 8-bit color plate image data of each of CMYK and generates, as appropriate, 2-bit clear toner plate image data for depositing a clear toner. The clear processing unit 56 generates, as appropriate, image data of the clear toner plate used by the printer machine 70 and image data of the clear toner plate used by the low-temperature fixing unit 90 and outputs the image data together with on/off information indicating on or off of the glosser 80.

The inverse mask is used for equalizing a total deposit amount of the CMYK toners and the clear toner on pixels included in a target region to which the surface effect is imparted. Specifically, image data obtained by adding up all the density values of the pixels included in the target region in the image data of color plates of CMYK and then subtracting the sum from a predetermined value is used as the inverse mask. For example, an inverse mask 1 described above is represented by the following Equation (1).

$$Clr=100-(C+M+Y+K)$$

$$\text{if } Clr<0, \text{ then } Clr=0 \quad (1)$$

In Equation (1), Clr, C, M, Y, and K represent density ratios calculated from the density values in the pixels for each of the clear toner and the toners C, M, Y, and K. In other words, according to Equation (1), a total deposit amount obtained by adding the amount of the clear toner to the total deposit amount of the toners C, M, Y, and K is set to 100% for all the pixels included in the target region to which the surface effect is imparted. When the total deposit amount of the toners C, M, Y, and K is equal to or larger than 100%, the clear toner is not deposited and the density ratio of the clear toner is set to 0%. This is because a portion where the total deposit amount of the toners C, M, Y, and K exceeds 100% is smoothed by fixing processing. As described above, by setting the total deposit amount of the toner on all the pixels included in the target region, to which the surface effect is imparted, to be equal to or larger than 100%, the surface irregularity caused by a difference in the total deposit amount of the toner in the target region is eliminated. As a result, a gloss is obtained by specular reflection of light. Some inverse mask is obtained by a formula other than the Equation (1). There could be a plurality of types of the inverse masks.

For example, the inverse mask can be configured to uniformly deposit the clear toner on each pixel. The inverse mask of this type is called solid mask and represented by the following Equation (2).

$$Clr=100 \quad (2)$$

It is possible to set a density ratio other than 100% to some of the pixels in the target region to which the surface effect is imparted. Therefore, there could be a plurality of patterns of the solid masks.

For example, the inverse mask can be obtained by multiplication of background exposure ratios of the respective colors. The inverse mask of this type is represented by, for example, the following Equation (3).

$$Clr=100\times\{(100-C)/100\}\times\{(100-M)/100\}\times\{(100-Y)/100\}\times\{(100-K)/100\} \quad (3)$$

In the above Equation (3), (100−C)/100 represents a background exposure ratio of C, (100−M)/100 represents a background exposure ratio of M, (100−Y)/100 represents a background exposure ratio of Y, and (100−K)/100 represents a background exposure ratio of K.

For example, the inverse mask can be obtained by a method based on the assumption that halftone dots having the maximum region ratio regulate the smoothness. The inverse mask of this type is represented by, for example, the following Equation (4).

$$Clr=100-\max(C,M,Y,K) \quad (4)$$

In the above Equation (4), max (C, M, Y, K) indicates that a density value of a color indicating the maximum density value among CMYK is used as a representative value.

In short, the inverse mask only has to be represented by any one of Equations (1) to (4).

The surface effect selection table is a table including a correspondence relation between a density value serving as a gloss control value indicating a surface effect and a type of the surface effect and indicates a correspondence relation among the density value and the type of the surface effect, control information related to a post-processor corresponding to the configuration of the image forming system, and image data of the clear toner plate used by the printer machine 70 and image data of the clear toner plate used by the post-processor. The image forming system can be configured in various ways. However, in this embodiment, the glosser 80 and the low-temperature fixing unit 90 is connected to the printer machine 70 as the post-processors. Therefore, the control information concerning the post-processor corresponding to the configuration of the image forming system is the on/off information indicating on or off of the glosser 80. As the image data of the clear toner plate used by the post-processor, there is image data of the clear toner plate used by the low-temperature fixing unit 90. FIG. 18 is a diagram of an example of a data structure of the surface effect selection table. The surface effect selection table can be structured to indicate, for each of the configurations of different image forming systems, the correspondence relation among the control information concerning the post-processor, image data of the clear toner plate 1 used by the printer machine 70 and image data of the clear toner plate 2 used by the post-processor, and the density value and the type of the surface effect. In FIG. 18, the data structure corresponding to the configuration of the image forming system according to this embodiment is shown as an example. In the correspondence relation between the type of the surface effect and the density value shown in the figure, types of the surface effects are associated with each range of the density values. The types of the surface effects are associated with a percentage of the density (density ratio), which is calculated from a value representing the range of the density value (the representative value), in a unit of 2%. Specifically, the surface effect for imparting gloss (the surface effect and the solid effect) is associated with a range of the density values ("212" to "255") having the density ratios equal to or higher than 84%. The surface effect for suppressing a gloss (the Matte and the Premium Matte) is associated with a range of the density values ("1" to "43") having the density ratios equal to or lower than 16%. The surface effect such as a texture or a woven pattern watermark is associated with a range of the density values having the density ratios of 20% to 80%.

More specifically, for example, the Premium Gloss (PM: Premium Gloss) as the surface effect is associated with the pixel values of "238" to "255". Different types of Premium Gloss are respectively associated with three ranges of pixel values: "238" to "242"; "243" to "247"; and "248" to "255".

The solid gross (G: Gross) is associated with the pixel values of "212" to "232". Different types of Gloss are respectively associated with four ranges of pixel values: "212" to "216"; "217" to "221"; "222" to "227"; and "228" to "232". The Matte (M) is associated with pixel values of "23" to "43". Different types of the Matte are respectively associated with four ranges of pixel values: "23" to "28"; "29" to "33"; "34" to "38"; and "39" to "43". The Premium matte (PM) is associated with pixel values of "1" to "17". Different types of the Premium Matte are respectively associated with three ranges of pixel values: "1" to "7"; "8" to "12"; and "13" to "17". The different types of the same surface effect are different in formulas for obtaining the image data of the clear toner plate used by the printer machine 70 or the low-temperature fixing unit 90. However, the operations performed by the printer main body and the post-processors are the same. Information indicating that no surface effect is imparted is associated with the density value of "0".

In FIG. 18, the on/off information indicating on or off of the glosser 80, contents of the image data of the clear toner plate 1 (Clr-1 shown in FIG. 1) used by the printer machine 70 and the image data of the clear toner plate 2 (Clr-2 shown in FIG. 1) used by the low-temperature fixing unit 90 are respectively indicated to correspond to the pixel values and the surface effects. For example, it is indicated that, when the surface effect is the Premium Gloss, the glosser 80 is turned on and that the image data of the clear toner plate 1 used by the printer machine 70 represents an inverse mask and there is no data as the image data of the clear toner plate 2 used by the low-temperature fixing unit 90. The inverse mask is obtained by, for example, the above Equation (1). The example shown in FIG. 18 is an example in which a region where the surface effect is designated as the surface effect is equivalent to the entire region specified by the image data. An example in which a region where the surface effect is designated as the surface effect is equivalent to a part of the entire region specified by the image data is explained below.

It is indicated that, when the density value is in the range of "228" to "232" and the surface effect is the Gloss, the glosser 80 is turned off and that the image data of the clear toner plate 1 used by the printer machine 70 is the inverse mask 1 and there is no data as the image data of the clear toner plate 2 used by the low-temperature fixing unit 90. The inverse mask 1 only has to be an inverse mask represented by any one of Equations (1) to (4). Because the glosser 80 is off, the total deposit amount of the toners to be smoothed is different. Therefore, the surface irregularity increases because of the Premium Gloss and, as a result, the Gloss having low glossiness is obtained by the Premium Gloss. It is indicated that, when the surface effect is the Matte, the glosser 80 is turned off and that the clear toner image data 1 used by the printer machine 70 represents halftone (halftone dot) and there is no data as the image data of the clear toner plate 2 used by the low-temperature fixing unit 90. It is indicated that, when the surface effect is the Matte, the glosser 80 can be either turned on or off and that there is no data as the image data of the clear toner plate 1 used by the printer machine 70 and the image data of the clear toner plate 2 used by the low-temperature fixing unit 90 represents the solid mask. The solid mask is obtained by, for example, the above Equation (2).

The clear processing unit 56 determines, referring to the above surface effect selection table, the surface effect associated with each pixel value indicated in the image data of the gloss control plate, determines on or off of the glosser 80, and determines what kinds of image data of the clear toner plate are used by the printer machine 70 and the low-temperature fixing unit 90. The clear processing unit 56 determines on or off of the glosser 80 for every one page. The clear processing unit 56 generates, as appropriate, the image data of the clear toner plate as described above according to the result of the determination, outputs the image data, and outputs the on/off information for the glosser 80.

The si3 unit 57 integrates the 2-bit color plate image data of each of CMYK subjected to the halftone processing and the 2-bit clear toner plate image data generated by the clear processing unit 56 and outputs the integrated image data to the MIC 60. In some cases, the clear processing unit 56 does not generate at least one of the image data of the clear toner plate 1 used by the printer machine 70 and the image data of the clear toner plate 2 used by the low-temperature fixing unit 90. Therefore, the si3 unit 57 integrates the image data of the clear toner plate generated by the clear processing unit 56. If the clear processing unit 56 does not generate both the image data of the clear toner plate, the si3 unit 57 outputs image data in which the 2-bit color plate image data of each of CMYK are integrated. As a result, the DFE 50 sends four to six 2-bit image data to the MIC 60. The si3 unit 57 also outputs the on/off information concerning the glosser 80, which is output by the clear processing unit 56, to the MIC 60.

Figure 19:
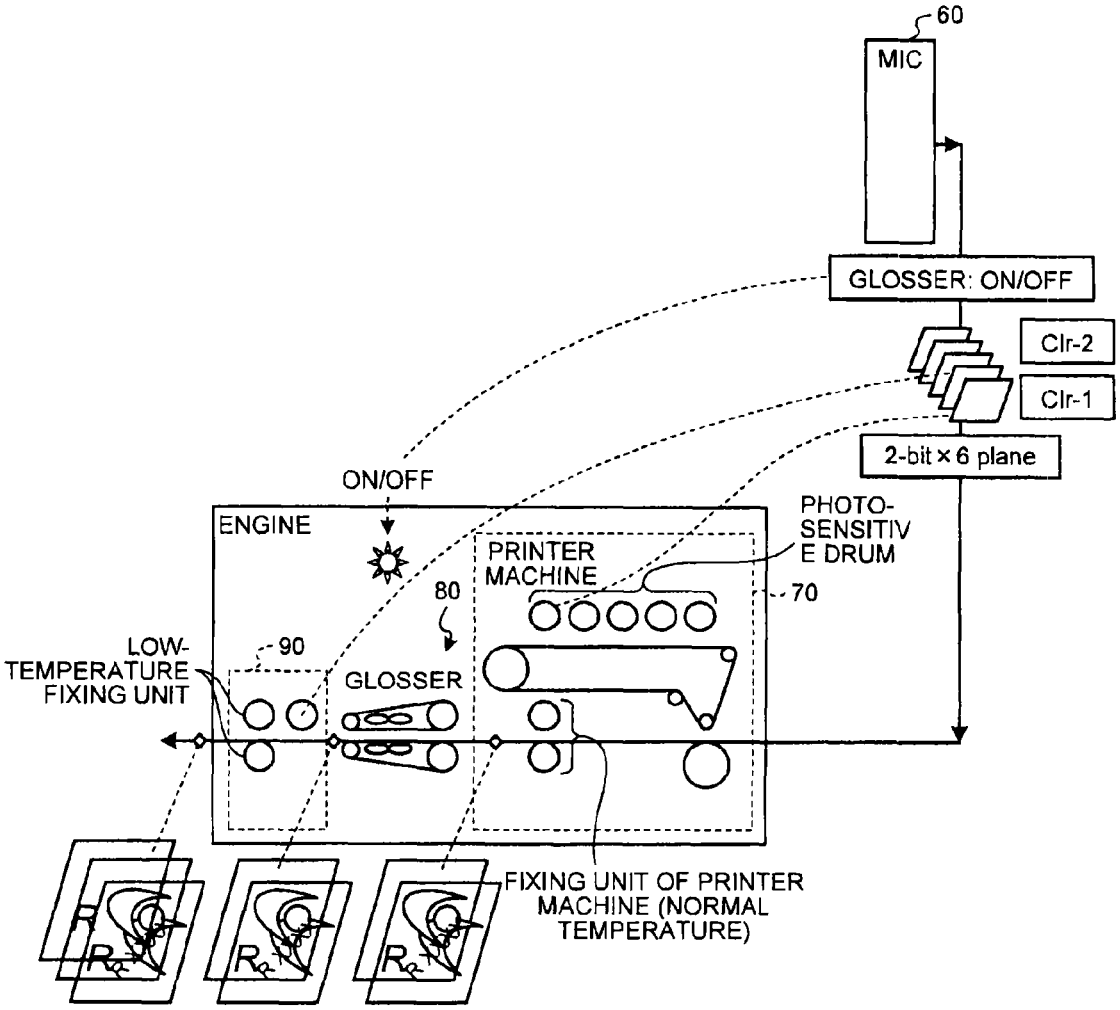
FIG. 19 is a schematic diagram of an example of the configuration of a mechanisms interface controller (MIC)

The MIC 60 outputs device configuration information indicating the configuration of the post-processors to the DFE 50. The MIC 60 is connected to the DFE 50 and the printer machine 70, receives the image data of the color plate and the image data of the clear toner plate from the DFE 50, distributes the received image data to devices corresponding thereto, and controls the post-processor. More specifically, as shown in FIG. 19 as an example, the MIC 60 outputs, to the printer machine 70, the image data of the color plates of CMYK among the image data output from the DFE 50. The MIC 60 also outputs the image data of the clear toner plate used by the printer machine 70 to the printer machine 70 when this image data is present. The MIC 60 turns on or off the glosser 80 using the on/off information output from the DFE 50. The MIC 60 outputs the image data of the clear toner plate used by the low-temperature fixing unit 90 to the low-temperature fixing unit 90 when this image data is present. The glosser 80 can switch, according to the on/off information, a path in which the fixing is performed and a path in which the fixing is not performed. The low-temperature fixing unit 90 can perform switching of on and off and switching of paths, which are the same as the paths switched by to the glosser 80, according to the presence or absence of the image data of the clear toner plate.

As illustrated in FIG. 19, a printing apparatus, which includes the printer machine 70, the glosser 80, and the low-temperature fixing unit 90, further includes a conveyor path for conveying the recording medium. The printer machine 70 includes a plurality of electrophotography photosensitive drums, a transfer belt onto which a toner image formed on the photosensitive drums is transferred, a transfer unit for the toner image on the transfer belt onto the recording medium, and a fixing unit for fixing the image toner on the recording medium. The recording medium is conveyed in the conveyor path (not illustrated) to the printer machine 70, the glosser 80, and the low-temperature fixing unit 90 in order. The recording medium is subjected to image formation process and surface effect process by the three devices and then discharged from the printing apparatus through a conveying mechanism (not illustrated).

Figure 20:
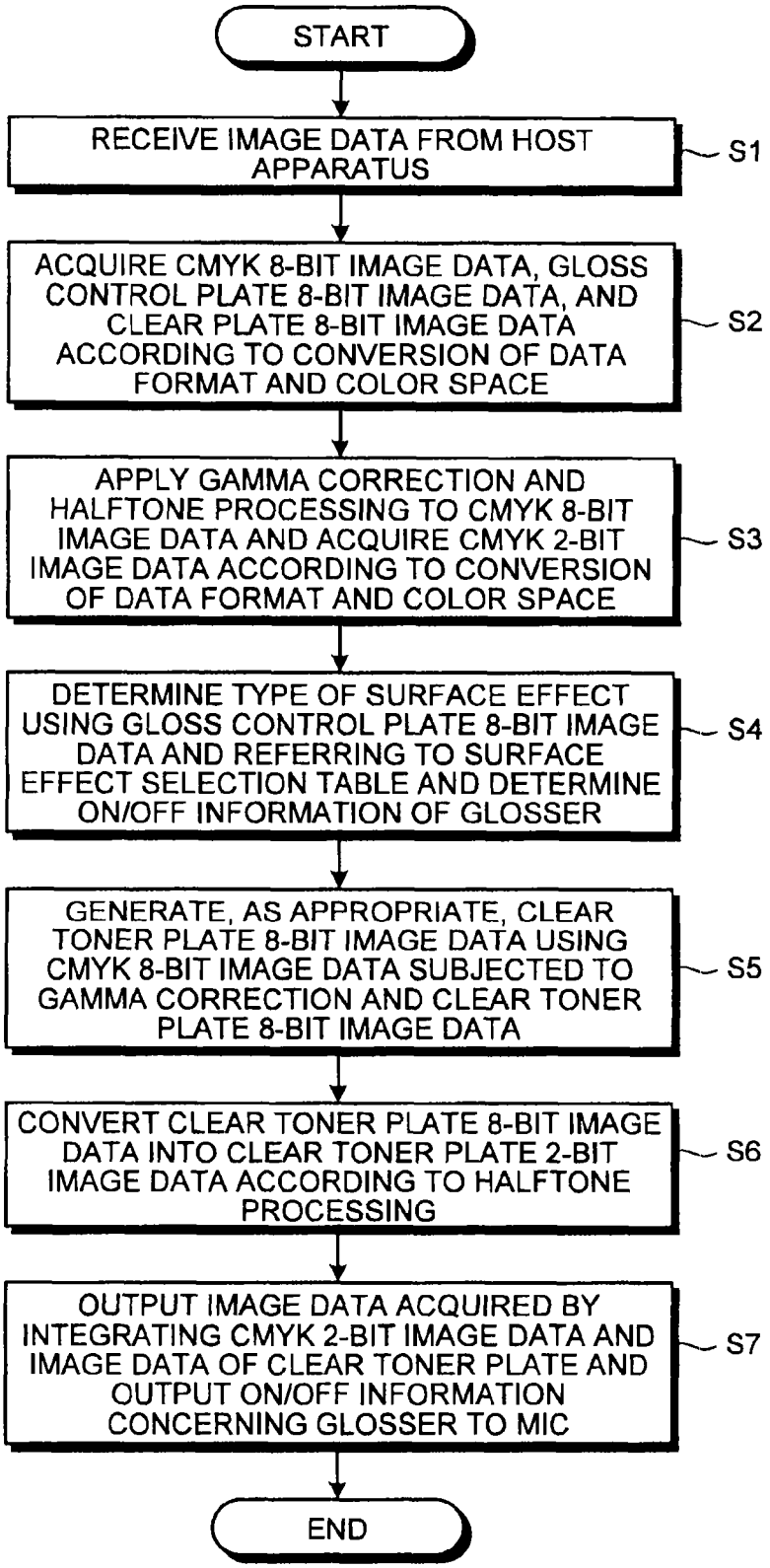
FIG. 20 is a flowchart for explaining a procedure of gloss control processing performed by the DFE according to the first embodiment.

A procedure of gloss control processing performed by the image forming system according to this embodiment is explained below with reference to FIG. 20. When the DFE 50 receives image data from the host apparatus 10 (step S1), the rendering engine 51 subjects the image data to language interpretation, converts the image data represented in the vector format into image data represented in the raster format, and converts the color space represented by the RGB format into a color space represented in the CMYK format to obtain 8-bit color plate image data of each of CMYK, 8-bit gloss control plate image data, and 8-bit clear toner plate image data (step S2).

Figure 21:
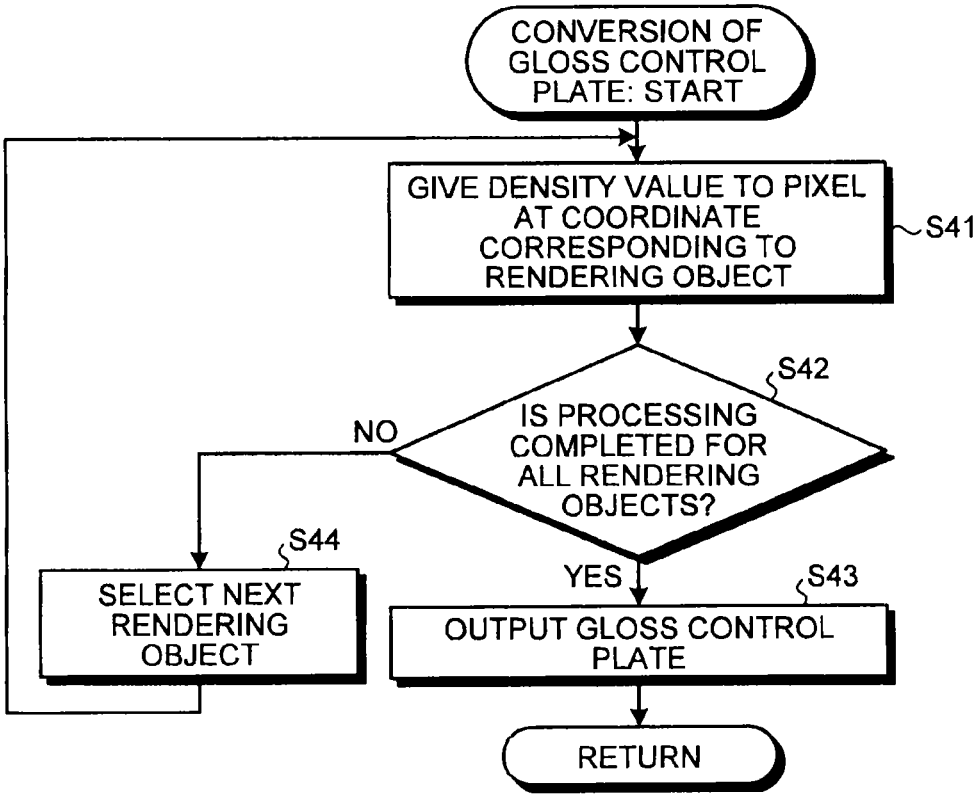
FIG. 21 is a flowchart for explaining a procedure of processing for converting the image data of the gloss control plate.

Details of the processing for converting the image data of the gloss control plate at step S2 are explained below. FIG. 21 is a flowchart for explaining a procedure of the processing for converting the image data of the gloss control plate. In the conversion processing, the image data of the gloss control plate shown in FIG. 4, i.e., the image data of the gloss control plate in which the density value for specifying the surface effect is designated for each rendering object shown in FIG. 13 is converted into image data of the gloss control plate in which the density value is designated for each pixel included in the rendering object.

The rendering engine 51 gives a density value set for a rendering object to pixels in the range of the coordinates corresponding to the rendering object in the image data of the gloss control plate shown in FIG. 16 (step S41) to thereby convert the image data of the gloss control plate. Thereafter, the rendering engine 51 determines whether such processing is completed for all of the rendering objects present in the image data of the gloss control plate (step S42).

When the processing is not completed for any of the rendering objects (No at step S42), the rendering engine 51 selects the next unprocessed rendering object in the image data of the gloss control plate (step S44) and repeats the processing at step S41.

On the other hand, at step S42, when the processing at step S41 is completed for all of the rendering objects included in the image data of the gloss control plate (Yes at step S42), the rendering engine 51 outputs the converted image data of the gloss control plate (step S43). According to the above processing, the image data of the gloss control plate is converted into the data in which the surface effect is set for each pixel.

Referring back to FIG. 20, when the 8-bit gloss control plate image data is output, the TRC 53 of the DFE 50 applies gamma correction to the 8-bit color plate image data of each of CMYK using a gamma curve of a 1D_LUT generated by calibration. The halftone engine 55 applies halftone processing to the image data subjected to the gamma correction to convert the image data into 2-bit color plate image data of each of CMYK for output to the printer machine 70 and obtain the 2-bit color plate image data of each of CMYK subjected to the halftone processing (step S3).

The clear processing unit 56 of the DFE 50 determines a surface effect designated for pixel values indicated by the image data of the gloss control plate using the 8-bit gloss control plate image data and referring to the surface effect selection table. The clear processing unit 56 performs such determination concerning all of the pixels included in the image data of the gloss control plate. The image data of the gloss control plate basically represents the density values in the same range concerning all pixels included in a region to which the same surface effect is imparted. Therefore, the clear processing unit 56 determines that pixels near the pixels determined as having the same surface effect are included in the region to which the same surface effect is imparted. As explained above, the clear processing unit 56 determines the region to which the surface effect is imparted and the type of the surface effect to be imparted to the region. The clear processing unit 56 determines on or off of the glosser 80 according to the determination (step S4).

Subsequently, the clear processing unit 56 of the DFE 50 generates, as appropriate, 8-bit clear toner plate image data for depositing the clear toner using the 8-bit color plate image data of each of CMYK subjected to the gamma correction and 8-bit clear toner plate image data (step S5). The halftone engine 55 converts the 8-bit clear toner plate image data based on the 8-bit image data into 2-bit clear toner plate image data according to the halftone processing (step S6).

The si3 unit 57 of the DFE 50 integrates the 2-bit color plate image data of each of CMYK subjected to the halftone processing obtained at step S3 and the 2-bit clear toner plate image data generated at step S6 and outputs the integrated image data and the on/off information indicating on or off of the glosser 80 determined at step S4 to the MIC 60 (step S7).

When the clear processing unit 56 does not generate the image data of the clear toner plate at step S5, at step S7, only the 2-bit color plate image data of each of CMYK subjected to the halftone processing obtained at step S3 are integrated and the integrated image data is output to the MIC 60.

Specific examples of the types of the surface effects are explained below. Types of the Premium Gloss and the Gloss for imparting a gloss and types of the Matte and the Premium Matte for suppressing a gloss are explained in detail. In the following explanation, the same types of the surface effect are designated in one page. At step S4, the clear processing unit 56 of the DFE 50 determines that the surface effect designated for pixels having the density values of "238" to "255" is the Premium Gloss using density values of pixels in the 8-bit gloss control plate image data and referring to the surface effect selection table shown in FIG. 18 as an example. In this case, the clear processing unit 56 of the DFE 50 further determines whether the region where the Premium Gloss is designated as the surface effect corresponds to the entire region specified by the image data. When the Premium Gloss is designated for the entire region, the clear processing unit 56 of the DFE 50 generates the inverse mask 1 according to, for example, Equation (1) using image data corresponding to the region in the 8-bit color plate image data of each of CMYK subjected to the gamma correction. Data representing the inverse mask is the image data of the clear toner plate used by the printer machine 70. Because the low-temperature fixing unit 90 does not use image data of the clear toner plate for the region, the DFE 50 does not generate the image data of the clear toner plate used by the low-temperature fixing unit 90. At step S7, the si3 unit 57 of the DFE 50 integrates the image data of the clear toner plate used by the printer machine 70 and the 2-bit color plate image data of each of CMYK subjected to the halftone processing obtained at step S3 and outputs the integrated image data and the on/off information indicating on of the glosser 80 to the MIC 60. The MIC 60 outputs, to the printer machine 70, the image data of the color plates of CMYK and the image data of the clear toner plate used by the printer machine 70, which are the image data output from the DFE 50, and turns on the glosser 80 using the on/off information output from the DFE 50. The printer machine 70 emits a light beam from the exposing device to form toner images corresponding to the respective toners on the photosensitive drums using the image data of the color plates of CMYK and the image data of the clear toner plate output from the MIC 60, transfers the toner images onto paper, and fixes the toner images on the paper by heating and pressing at a normal temperature. Consequently, the clear toner is deposited on the paper besides the CMYK toners and an image is formed. Thereafter, the glosser 80 presses the paper at high temperature and high pressure. Because the image data of the clear toner plate is not output to the low-temperature fixing unit 90, the low-temperature fixing unit 90 discharges the paper without the clear toner deposited thereon. As a result, because the total deposit amount of the CMYK toners and the clear toner is uniformly compressed over the entire region specified by the image data, an intense gloss is obtained from the surface of the region.

On the other hand, when the region where the Premium Gloss is designated as the surface effect corresponds to a part of the entire region specified by the image data, the following situations could occur. First, the image data of the clear toner plate representing the above inverse mask is used for the region where the Premium Gloss is designated. However, if a total deposit value of the CMYK toners equal to or larger than a predetermined value is set to all pixels in a region other than the designated region, when the glosser 80 presses the paper, the total deposit amount of the CMYK toners and the clear toner is equalized between the region where the Premium Gloss is designated and the region where the total deposit value of the CMYK toners is equal to or larger than the predetermined value.

For example, when the total deposit value of the CMYK toners set to all the pixels included in the region specified by the image data is equal to or larger than the predetermined value, a result is obtained that is the same as that obtained when the Premium Gloss is designated for the entire region specified by the image data.

Therefore, when the region where the Premium Gloss is designated as the surface effect is equivalent to a part of the entire region specified by the image data, the DFE 50 generates image data of the clear toner plate same as that generated when the Premium Gloss is designated for the entire region specified by the image data. After the clear toner is deposited on the paper, the glosser 80 presses the paper. Subsequently, the DFE 50 generates image data of the clear toner plate used by the low-temperature fixing unit 90 to apply a matte surface effect to the region other than the region where the surface effect is designated as the surface effect on the paper pressed by the glosser 80.

Specifically, the DFE 50 generates, as the image data of the clear toner plate used by the printer machine 70, the inverse mask according to Equation (1) in the same manner as explained above. Further, the DFE 50 generates, as the image data of the clear toner plate used by the low-temperature fixing unit 90, the solid mask according to Equation (2) for the region other than the region where the Premium Gloss is designated as the surface effect. At step S7, the si3 unit 57 of the DFE 50 integrates the image data of the clear toner plate used by the printer machine 70, the image data of the clear toner plate used by the low-temperature fixing unit 90, and the 2-bit color plate image data of each of CMYK subjected to the halftone processing obtained at step S3, and outputs the integrated image data and the on/off information indicating on of the glosser 80 to the MIC 60.

The MIC 60 outputs, to the printer machine 70, the image data of the color plates of CMYK and the image data of the clear toner plate used by the printer machine 70 among the image data output from the DFE 50, turns on the glosser 80 using the on/off information output from the DFE 50, and outputs, to the low-temperature fixing unit 90, the image data of the clear toner plate used by the low-temperature fixing unit 90 among the image data output from the DFE 50. The printer machine 70 forms an image, on which the CMYK toners and the clear toner are deposited, on paper using the image data of the color plates of CMYK and the image data of the clear toner plate output from the MIC 60. Thereafter, the glosser 80 presses the paper at high temperature and high pressure. The low-temperature fixing unit 90 forms a toner image by the clear toner using the image data of the clear toner plate output from the MIC 60, superimposes the toner image on the paper passed through the glosser 80, and fixes the toner image on the paper by heating and pressing at low temperature. As a result, because the total deposit amount of the CMYK toners and the clear toner is uniformly compressed in the region where the Premium Gloss is designated, an intense gloss is obtained from the surface of the region. On the other hand, because the clear toner is deposited by the solid mask after the glosser 80 presses the paper, surface irregularity occurs in the region other than the region where the Premium Gloss is designated and the gloss on the surface of the region is suppressed.

At step S4, the clear processing unit 56 of the DFE 50 determines that the surface effect designated for pixels having the density values of "212" to "232" is the Gloss using density values represented by pixels in the 8-bit gloss control plate image data and referring to the surface effect selection table. In particular, the clear processing unit 56 determines that the Gloss, type 1 is designated for pixels having the density values of "228" to "232". In this case, the clear processing unit 56 of the DFE 50 generates the inverse mask 1 using image data corresponding to the region in the 8-bit color plate image data of each of CMYK subjected to the gamma correction. Data representing the inverse mask 1 is used as the image data of the clear toner plate used by the printer machine 70. Because the low-temperature fixing unit 90 does not use image data of the clear toner plate for the region, the DFE 50 does not generate the image data of the clear toner plate used by the low-temperature fixing unit 90. At step S7, the si3 unit 57 of the DFE 50 integrates the image data of the clear toner plate used by the printer machine 70 and the 2-bit color plate image data of each of CMYK subjected to the halftone processing obtained at step S3 and outputs the integrated image data and the on/off information indicating off of the glosser 80 to the MIC 60. The MIC 60 outputs, to the printer machine 70, the image data of the color plates of CMYK and the image data of the clear toner plate used by the printer machine 70, which are the image data output from the DFE 50, and turns off the glosser 80 using the on/off information output from the DFE 50. The printer machine 70 forms an image, on which the CMYK toners and the clear toner are deposited, on the paper using the image data of the color plates of CMYK and the image data of the clear toner plate used by the printer machine 70, which are output from the MIC 60. Because the glosser 80 is off, thereafter, the paper is not pressed at high temperature and high pressure. Because the image data of the clear toner plate is not output to the low-temperature fixing unit 90, the low-temperature fixing unit 90 discharges the paper without the clear toner deposited thereon. As a result, the total deposit amount of the CMYK toners and the clear toner becomes relatively uniform in the region where the Gloss is designated as the surface effect. As a result, a slightly intense gloss is obtained from the surface of the region.

At step S4, the clear processing unit 56 of the DFE 50 determines that the surface effect designated for pixels having the density values of "23" to "43" is the Matte using the density value of each pixel in the 8-bit gloss control plate image data and referring to the surface effect selection table. In this case, the clear processing unit 56 of the DFE 50 generates image data representing halftone as the image data of the clear toner plate used by the printer machine 70. Because the low-temperature fixing unit 90 does not use image data of the clear toner plate for the region, the DFE 50 does not generate the image data of the clear toner plate used by the low-temperature fixing unit 90. At step S7, the si3 unit 57 of the DFE 50 integrates the image data of the clear toner plate used by the printer machine 70 and the 2-bit color plate image data of each of CMYK subjected to the halftone processing obtained at step S3, and outputs the integrated image data and the on/off information indicating on of the glosser 80 to the MIC 60. The MIC 60 outputs, to the printer machine 70, the image data of the color plates of CMYK and the image data of the clear toner plate used by the printer machine 70, which are the image data output from the DFE 50, and turns off the glosser 80 using the on/off information output from the DFE 50. The printer machine 70 forms an image, on which the CMYK toners and the clear toner are deposited, on the paper using the image data of the color plates of CMYK and the image data of the clear toner plate output from the MIC 60. Because the glosser 80 is off, thereafter, the paper is not pressed at high temperature and high pressure. Because the image data of the clear toner plate is not output to the low-temperature fixing unit 90, the low-temperature fixing unit 90 discharges the paper without the clear toner deposited thereon. As a result, because the halftone dots are added by the clear toner to the region where the Matte is designated as the surface effect, surface irregularity occurs in the region and the gloss on the surface of the region is slightly suppressed.

At step S4, the clear processing unit 56 of the DFE 50 determines that the surface effect designated for pixels having the density values of "1" to "17" is the Premium Matte using the density value of each pixel in the 8-bit gloss control plate image data and referring to the surface effect selection table. In this case, when another surface effect is designated in the same page (explained later), the clear processing unit 56 of the DFE 50 determines on or off of the glosser 80 according to the setting of the other surface effect. Regardless of whether the glosser 80 is on or off, the clear processing unit 56 does not generate the image data of the clear toner plate used by the printer machine 70 and generates a solid mask as the image data of the clear toner plate used by the low-temperature fixing unit 90. At step S7, the si3 unit 57 of the DFE 50 integrates the image data of the clear toner plate used by the low-temperature fixing unit 90 and the 2-bit color plate image data of each of CMYK subjected to the halftone processing obtained at step S3 and outputs the integrated image data and the on/off information indicating on or off of the glosser 80 to the MIC 60. The MIC 60 outputs, to the printer machine 70, the image data of the color plates of CMYK among the image data output from the DFE 50 and outputs, to the low-temperature fixing unit 90, the image data of the clear toner plate used by the low-temperature fixing unit 90 among the image data output from the DFE 50. The printer machine 70 forms an image, on which the CMYK toners are deposited, on the paper using the image data of the color plates of CMYK output from the MIC 60. When the glosser 80 is turned on, the glosser 80 presses the paper at high temperature and high pressure. When the glosser 80 is turned off, the paper is not pressed at high temperature and high pressure. The low-temperature fixing unit 90 forms a toner image by the clear toner using the image data of the clear toner plate output from the MIC 60, superimposes the toner image on the paper passed through the glosser 80, and fixes the toner image on the paper by heating and pressing at low temperature. As a result, because the clear toner by the solid mask is deposited on the region where the Premium Matte is designated as the surface effect, surface irregularity occurs in the region and the gloss on the surface of the region is suppressed.

In the above explanation, the same surface effect is designated in one page. However, when different types of surface effects are designated in one page, the same surface effects can be realized by the processing explained above. Specifically, when a plurality of surface effects are designated in one page, density values corresponding to types of the surface effects shown in FIG. 18 is set in pixels included in a region to which the types of the surface effects are imparted in the image data of the gloss control plate. Specifically, in the image data of the gloss control plate, a region to which a surface effect is imparted is designated according for each type of the surface effect. Therefore, the DFE 50 only has to determine, as a region to which the same surface effect is imparted, a range of pixels for which the same density value is set in the image data of the gloss control plate. It is possible to easily realize the surface effects in one page.

However, when a plurality of types of surface effects are designated in one page according to the density values in the image data of the gloss control plate, on or off of the glosser 80 cannot be switched in the same page. Therefore, there are types of surface effects that can be realized simultaneously, while there are types of surface effects that cannot be realized simultaneously.

In this embodiment in which the configuration including the printer machine 70, the glosser 80, and the low-temperature fixing unit 90 is adopted as shown in FIG. 1, when the Premium Gloss (PG) and the Premium Matte (PM) are designated as the surface effects in one page, according to FIG. 18, the glosser 80 is turned on for the Premium Gloss (PM) and the on or off of the glosser 80 for the Premium Matte (PM) conforms to the designation of another surface effect in a page. Therefore, it is possible to simultaneously realize these two types of the surface effects in one page.

In this case, at step S4, the clear processing unit 56 of the DFE 50 determines that the surface effect designated for a region of pixels having the density values of "238" to "255" is the Premium Gloss (PG) using the density values of the pixels in the 8-bit gloss control plate image data and referring to the surface effect selection table illustrated in FIG. 18. The clear processing unit 56 of the DFE 50 generates an inverse mask according to, for example, Equation (1) using the image data corresponding to the region in the 8-bit color plate image data of each of CMYK subjected to the gamma correction. Data representing the inverse mask is the image data of the clear toner plate used by the printer machine 70 for the region where the Premium Gloss (PM) is designated as the surface effect. Because the low-temperature fixing unit 90 does not use image data of the clear toner plate for the region where the Premium Gloss is designated, the DFE 50 does not generate the image data of the clear toner plate used by the low-temperature fixing unit 90 for the region where the Premium Gloss is designated.

Further, at step S4, the clear processing unit 56 of the DFE 50 determines that the surface effect designated for the region of pixels having the density values of "1" to "17" is the Premium Matte (PM) in the same page referring to the surface effect selection table in the same manner. In this case, the clear processing unit 56 of the DFE 50 determines that the on/off information indicates on of the glosser 80 according to the setting of the Premium Gloss, which is another surface effect in one page. The clear processing unit 56 does not generate the image data of the clear toner plate used by the printer machine 70 for the region where the Premium Matte is designated and generates a solid mask as the image data of the clear toner plate used by the low-temperature fixing unit 90 for the region where the Premium Matte is designated.

At step S7, the si3 unit 57 of the DFE 50 integrates the image data of the clear toner plate used by the printer machine 70 for the region where the Premium Gloss is designated, the image data of the clear toner plate used by the low-temperature fixing unit 90 for the region where the Premium Matte is designated, and the 2-bit color plate image data of each of CMYK subjected to the halftone processing obtained at step S3 and outputs the integrated image data and the on/off information indicating on of the glosser 80 to the MIC 60.

The MIC 60 outputs, to the printer machine 70, the image data of the color plates of CMYK and the image data of the clear toner plate used by the printer machine 70 for the region where the Premium Gloss is designated among the image data output from the DFE 50. The MIC 60 also outputs, to the low-temperature fixing unit 90, the image data of the clear toner plate used by the low-temperature fixing unit 90 for the region where the Premium Matte is designated among the image data output from the DFE 50 and turns on the glosser 80 using the on/off information output from the DFE 50.

The printer machine 70 emits a laser beam from the exposing device and forms toner images corresponding to the respective toners on the photosensitive elements using the image data of the color plates of CMYK and the image data of the clear toner plate used for the region where the Premium Gloss is designated, which are output from the MIC 60, transfers the toner images onto paper, and fixes the toner images on the paper by heating and pressing at a normal temperature. Consequently, the clear toner is deposited on the paper besides the CMYK toners and an image is formed. Thereafter, the glosser 80 presses the paper at high temperature and high pressure.

The low-temperature fixing unit 90 forms a toner image by the clear toner using the image data of the clear toner plate used for the region where the Premium Matte is designated, which is output from the MIC 60, superimposes the toner image on the paper passed through the glosser 80, and fixes the toner image on the paper by heating and pressing at low temperature. As a result, an intense gloss is obtained from the surface of the region where the Premium Gloss is designated as the surface effect. Because the clear toner is deposited by the solid mask, surface irregularity occurs in the region where the Premium Matte is designated as the surface effect and the gloss on the surface of the region is suppressed.

Besides, in the configuration of the embodiment, when the surface effects of the Gloss (G), the Matte (M), and the Premium Matte (PM) are designated in one page, according to FIG. 18, the glosser 80 is turned off for the Gloss (G) and the Matte (M) and the on or off of the glosser 80 for the Premium Matte (PM) conforms to the designation of the other surface effects. Therefore, it is possible to simultaneously realize these three types of the surface effects in one page.

More specifically, at step S4, the clear processing unit 56 of the DFE 50 determines that the surface effect designated for pixels having the density values of "212" to "232" is the Gloss using the density values represented by the pixels of the 8-bit gloss control plate image data and referring to the surface effect selection table. In particular, the clear processing unit 56 determines that the surface effect is the Gloss, type 1 for pixels having the density values of "228" to "232". In this case, the clear processing unit 56 of the DFE 50 generates the inverse mask 1 using the image data corresponding to the region in the 8-bit color plate image data of each of CMYK subjected to the gamma correction. Data representing the inverse mask 1 is the image data of the clear toner plate used by the printer machine 70 for the region where the Gloss is designated. Because the low-temperature fixing unit 90 does not use image data of the clear toner plate for the region where the Gloss is designated, the DFE 50 does not generate the image data of the clear toner plate used by the low-temperature fixing unit 90.

At step S4, the clear processing unit 56 of the DFE 50 determines that the surface effect designated for pixels having the density values of "23" to "43" is the Matte (M) in the same page referring to the surface effect selection table in the same manner. In this case, the clear processing unit 56 of the DFE 50 generates image data representing halftone as the image data of the clear toner plate used by the printer machine 70 for the region where the Matte is designated. Because the low-temperature fixing unit 90 does not use image data of the clear toner plate for the region where the Matte is designated, the DFE 50 does not generate the image data of the clear toner plate used by the low-temperature fixing unit 90.

Further, at step S4, the clear processing unit 56 of the DFE 50 determines that the surface effect designated for pixels having the density values of "1" to "17" is the Premium Matte (PM) in the same page referring to the surface effect selection table in the same manner. In this case, the clear processing unit 56 of the DFE 50 sets on or off of the glosser 80 to off according to the setting of the Gloss and the Matte that are the other surface effects designated in the one page. The clear processing unit 56 does not generate the image data of the clear toner plate used by the printer machine 70 for the region where the Premium Matte is designated and generates, as the image data of the clear toner plate used by the low-temperature fixing unit 90, a solid mask for the region where the Premium Matte is designated.

At step S7, the si3 unit 57 of the DFE 50 integrates the image data of the clear toner plate used by the printer machine 70 for the region where the Gloss is designated, the image data of the clear toner plate used by the printer machine 70 for the region where the Matte is designated, the image data of the clear toner plate used by the low-temperature fixing unit 90 for the region where the Premium Matte is designated, and the 2-bit color plate image data of each of CMYK subjected to the halftone processing obtained at step S3. The si3 unit 57 outputs the integrated image data and the on/off information indicating off of the glosser 80 to the MIC 60.

The MIC 60 outputs, to the printer machine 70, the image data of the color plates of CMYK, the image data of the clear toner plate used by the printer machine 70 for the region where the Gloss is designated, and the image data of the clear toner plate used by the printer machine 70 for the region where the Matte is designated, which are the image data output from the DFE 50. The MIC 60 turns off the glosser 80 using the on/off information output from the DFE 50. The MIC 60 outputs, to the low-temperature fixing unit 90, the image data of the clear toner plate used by the low-temperature fixing unit 90 for the region where the Premium Matte is designated among the image data output from the DFE 50.

The printer machine 70 forms an image, on which the CMYK toners and the clear toner are deposited, on the paper using the CMYK image, the image data of the clear toner plate used by the printer machine 70 for the region where the Gloss is designated, and the image data of the clear toner plate used by the printer machine 70 for the region where the Matte is designated, which are output from the MIC 60. Because the glosser 80 is off, thereafter, the paper is not pressed at high temperature and high pressure.

The low-temperature fixing unit 90 forms a toner image by the clear toner for the region where the Premium Matte is designated using the image data of the clear toner plate for the region where the Premium Matte is designated, which is output from the MIC 60. The low-temperature fixing unit 90 superimposes the toner image on the paper and fixes the toner image on the paper through heating and pressing at low temperature.

As a result, the total deposit amount of the CMYK toners and the clear toner becomes relatively uniform in the region where the Gloss is designated as the surface effect. A slightly intense gloss is obtained from the surface of the region. Further, because the halftone dots are added by the clear toner in the region where the Matte is designated as the surface effect in one page, surface irregularity occurs in the region and the gloss on the surface of the region is slightly suppressed. Moreover, because the clear toner by the solid mask is deposited in the region where the Premium Matte is designated as the surface effect, surface irregularity occurs in the region and the gloss on the surface of the region is suppressed.

As described above, when a plurality of different types of the surface effects are designated in the same page, if it is unnecessary to switch the on or off of the glosser 80 according to the surface effect, it is possible to realize the different types of the surface effects in one page. However, a plurality of different types of the surface effects for which on or off of the glosser 80 needs to be switched cannot be realized in one page.

For example, in the embodiment in which the configuration including the printer machine 70, the glosser 80, and the low-temperature fixing unit 90 is employed, when the Premium Gloss (PG) and the Gloss (G) are designated as the surface effects in one page, according to FIG. 18, the glosser 80 is turned on for the Premium Gloss (PM) and the glosser 80 is turned off for the Gloss (G). Therefore, the two types of the surface effects, i.e., the Premium Gloss (PG) and the Gloss (G) cannot be realized in one page.

As described above, the different types of the surface effects are designated in one page. However, when the surface effects cannot be realized in one page, in this embodiment, the DFE 50 substitutes a part of the types of the surface effects among the surface effects that cannot be simultaneously realized with a surface effect other than the designated surface effect and realizes the part of the types of the surface effects.

Figure 22:
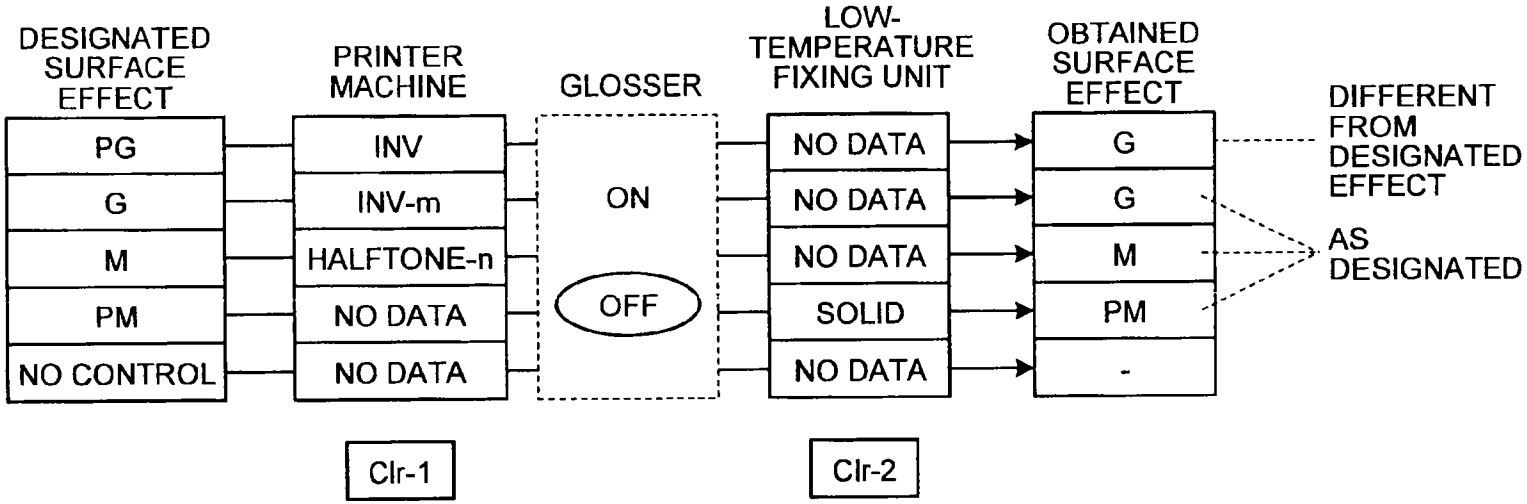
FIG. 22 is a diagram of comparison of a designated type of a surface effect, image data of the clear toner plate used in a printer, image data of the clear toner plate used in a low-temperature fixing unit, and a surface effect actually obtained.

For example, as shown in FIG. 22 as an example, when the four effects, i.e., the Premium Gloss (PM), the Gloss (G), the Matte (M), and the Premium Matte (PM), are designated in one page, the DFE 50 turns off the glosser 80, realizes the surface effects for a region where the surface effect is determined as the Gloss, a region where the surface effect is determined as the Matte, and a region where the surface effect is determined as the Premium Matte according to the density values in the image data of the gloss control plate and selects the Gloss as a substitute surface effect for a region where the surface effect is determined as the Premium Gloss. The DFE 50 generates, for the region where the surface effect is determined as the Premium Gloss, any one of the inverse masks A, B, and C as image data of the clear toner plate used by the printer machine 70 using image data corresponding to the region in the 8-bit color plate image data of each of CMYK subjected to the gamma correction in the same manner as in the case of the Gloss (corresponding to INV in FIG. 22). The DFE 50 does not generate image data of the clear toner plate used by the low-temperature fixing unit 90. In FIG. 18, when the density value is in the range of "248" to "255", the DFE 50 determines that the effect is a Premium Gloss, type A and uses an inverse mask A. "INV-m" in FIG. 22 corresponds to the inverse masks 1 to 4 in FIG. 18 and "HALFTONE-n" in FIG. 22 corresponds to halftone 1 to 4 in FIG. 18. As described above, on the paper discharged through the printer machine 70, the glosser 80 set to off, and the low-temperature fixing unit 90 as explained above, the surface effect serving as the Gloss is imparted to the regions for which the Premium Gloss and the Gloss are designated, the surface effect serving as the Matte is imparted to the region where the Matte is designated, and the surface effect serving as the Matte is imparted to the region where the Premium Matte is designated. No surface effect is imparted to a region not designated as a region to which any surface effect is imparted.

As described above, the DFE 50 determines the presence or absence of post-processing in the post-processors using the image data of the gloss control plate in which the density values are set according to the types of the surface effects designated by a user and according to the presence or absence of the post-processors such as the glosser 80 and the low-temperature fixing unit 90 behind the printer machine 70 and types of the post-processors. The DFE 50 generates, as appropriate, image data of the clear toner plate for depositing the clear toner. Consequently, it is possible to generate the image data of the clear toner plate for imparting a common surface effect even in image forming systems having various configurations. It is possible to apply various surface effects by depositing the clear toner on an image formed with CMYK toner images. Therefore, the user can impart a desired surface effect by the clear toner to a print, on which an image is formed, without consuming labor and time.

In the embodiment, the density value for specifying the surface effect is set for each pixel of the image data of the gloss control plate. Therefore, it is possible to apply a plurality of types of surface effects in one page of paper.

Second Embodiment

A second embodiment is explained below. In the first embodiment, the form of generating the image data of the color plates of CMYK and the image data of the gloss control plate in the printer driver 18 of the host apparatus 10 is explained. In the second embodiment, a form of generating image data of the clear toner plate instead of the image data of the gloss control plate is explained. The same components as those in the first embodiment are denoted by the same reference numerals and signs and explanation of the components is omitted. The configuration of an image forming system according to the second embodiment is the same as that in the first embodiment explained with reference to FIG. 1.

Figure 23:
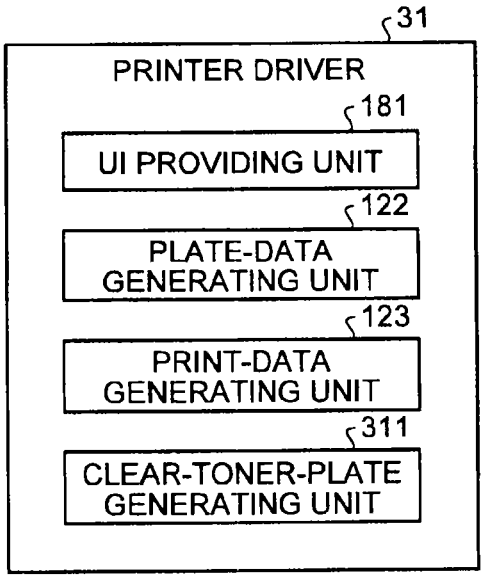
FIG. 23 is a diagram of an example of a functional configuration of a printer driver according to a second embodiment.

The host apparatus 10 is different from the host apparatus 10 according to the first embodiment in a functional configuration of a printer driver 18. FIG. 23 is a diagram of an example of a functional configuration of a printer driver 31 included in the host apparatus 10. As shown in the figure, the printer driver 31 includes, as a module group for playing functions of the driver, the UI providing unit 181, a plate-data generating unit 122, a print-data generating unit 123, and a clear-toner-plate generating unit 311. The functions and the configurations of the plate-data generating unit 122 and the print-data generating unit 123 are the same as those in the first embodiment.

The clear-toner-plate generating unit 311 receives the input of image data of color plates of CMYK and image data of a gloss control plate generated by the plate-data generating unit 122 and generates a clear toner plate based on the image data of the color plates of CMYK and the image data of the gloss control plate.

Specifically, the clear-toner-plate generating unit 311 determines, referring to the density value selection table stored in the storing unit 12, a region to which a surface effect is imparted and a type of the surface effect from a density value (a pixel value) represented by pixels included in the image data of the gloss control plate. The clear-toner-plate generating unit 311 determines on or off of the glosser 80 according to the determination and generates an inverse mask and a solid mask as appropriate using input 8-bit color plate image data of each of CMYK to thereby generate, as appropriate, image data of the clear toner plate for depositing the clear toner. A method of generating the image data of the clear toner plate is the same as the generation method in the clear processing unit 56 of the DFE 50 explained in the first embodiment. Therefore, explanation of the method is omitted.

The image data of the clear toner plate can be generated in 8 bits in the same manner as the image data of the color plates of CMYK and the image data of the gloss control plate or can be generated in another number of bits (e.g., 2 bits). The image data of the clear toner plate can be generated as, for example, a bitmap image or can be generated in another image format (e.g., TIFF, JPEG, or GIF). The clear toner plate can be represented using a page description language (PDL).

Figure 24:
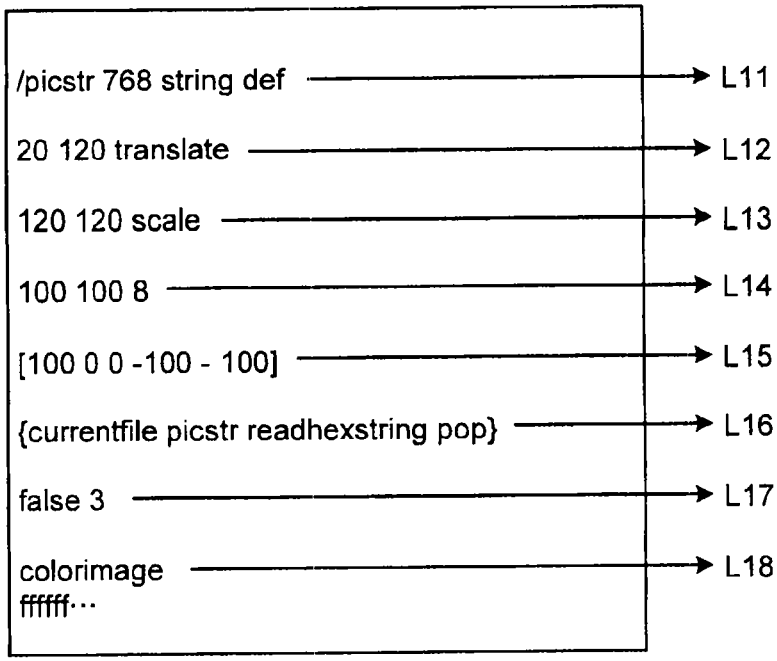
FIG. 24 is a diagram of an example of a command for image rendering.

For example, in the case of post script (PS), the clear toner plate can be represented as shown in FIG. 24 using a command for image rendering. FIG. 24 is a diagram of an example in which the clear toner plate concerning a portion of the region A11 of the image data G1 shown in FIG. 10 is represented using the command for image rendering. The command shown in the figure instructs to place the lower left corner of an image region of 100×100 pixels and 8 bits equivalent to the region A11 in a coordinate (20, 120) corresponding to a presence position of the region A11 in a space equivalent to the size of the image data G1 (hereinafter referred to as current space) and expand a coordinate system itself of the current space to 120 times in the width direction and the height direction.

Specifically, a line L11 is a comment sentence and indicates that this command is a character string for storing 256 (8 bits) sample values concerning each of RGB. A line L12 instructs movement to the coordinate (20, 120) in the current space. A line L13 instructs to expand the width and the height of the current space to 120 times. The line L14 instructs the size (100×100 pixels and 8 bits) of a source image (the region A11). A line L15 instructs to map a unit square of 100 pixels to the source image (the region A11). The line L16 instructs to read an image of the portion of the region A11 from the image data (or the CMYK plates). A line L17 instructs to interleave three color values of RGB concerning a read image. In a line L18 and subsequent lines, the interleaved color values of pixels (10000 samples) are described in hexadecimal characters. According to the command explained above, it is possible to represent the clear toner version in which the interleaved color values of the pixels in the portion of the region A11 are mapped to the unit square in the current space.

When a plurality of regions (images) to which an image surface effect is imparted are repetition of the same image in the image data (or the image data of the color plates of CMYK), the clear toner plate can be represented using the repeated image and a command for image rendering that designates arrangement positions of the repeated image. For example, when a character string image "Text" repeatedly shown in image data G2 is set as a surface effect region in the gloss control plate, the clear toner plate can be represented using one character string image extracted from the image data G2 and a command for image rendering that designates positions where the character string image is arranged on the current space. In this case, the command for image rendering can be represented as shown in FIG. 26.

Figure 25:
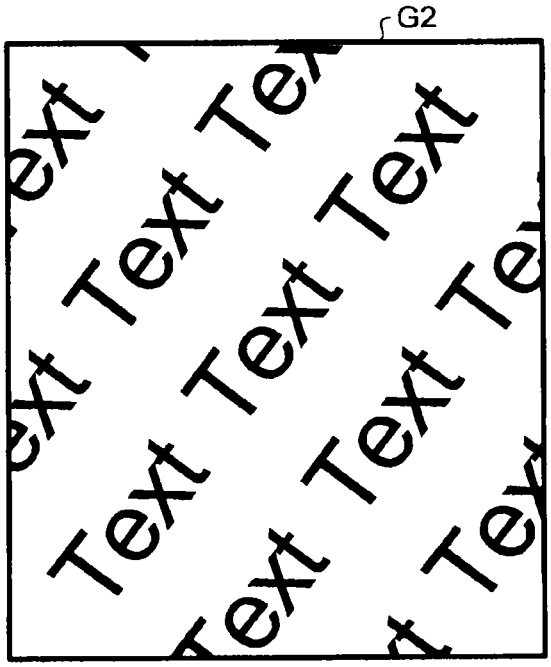
FIG. 25 is a diagram of an example of image data.
Figure 26:
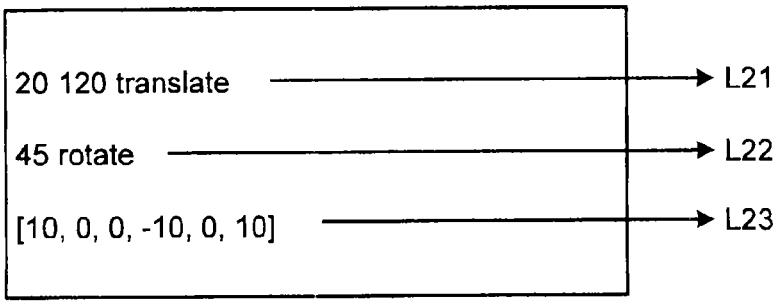
FIG. 26 is a diagram of an example of a command for image rendering.

FIG. 26 is a diagram of an example of the command for image rendering. A line L21 instructs movement to the coordinate (20, 120) in the current space equivalent to the size of the image data G2. A line L22 instructs to rotate the source image (the region A11) 45 degrees counterclockwise in the coordinate designated by the line L21. A Line L23 instructs to map a unit square of 10 pixels to a source image (a character string image). In this way, arrangement positions of a repeated image (the character string image) are designated using the command for image rendering. Consequently, it is possible to represent the clear toner plate that designates each of the character string images shown in FIG. 25.

The print-data generating unit 123 integrates the image data of the color plates of CMYK and the image data of the gloss control plate generated by the plate-data generating unit 122 and the image data of the clear toner plate generated by the clear-toner-plate generating unit 311 to generate print data and transmits the print data to the DFE 50 via the communication unit 15.

Figure 27:
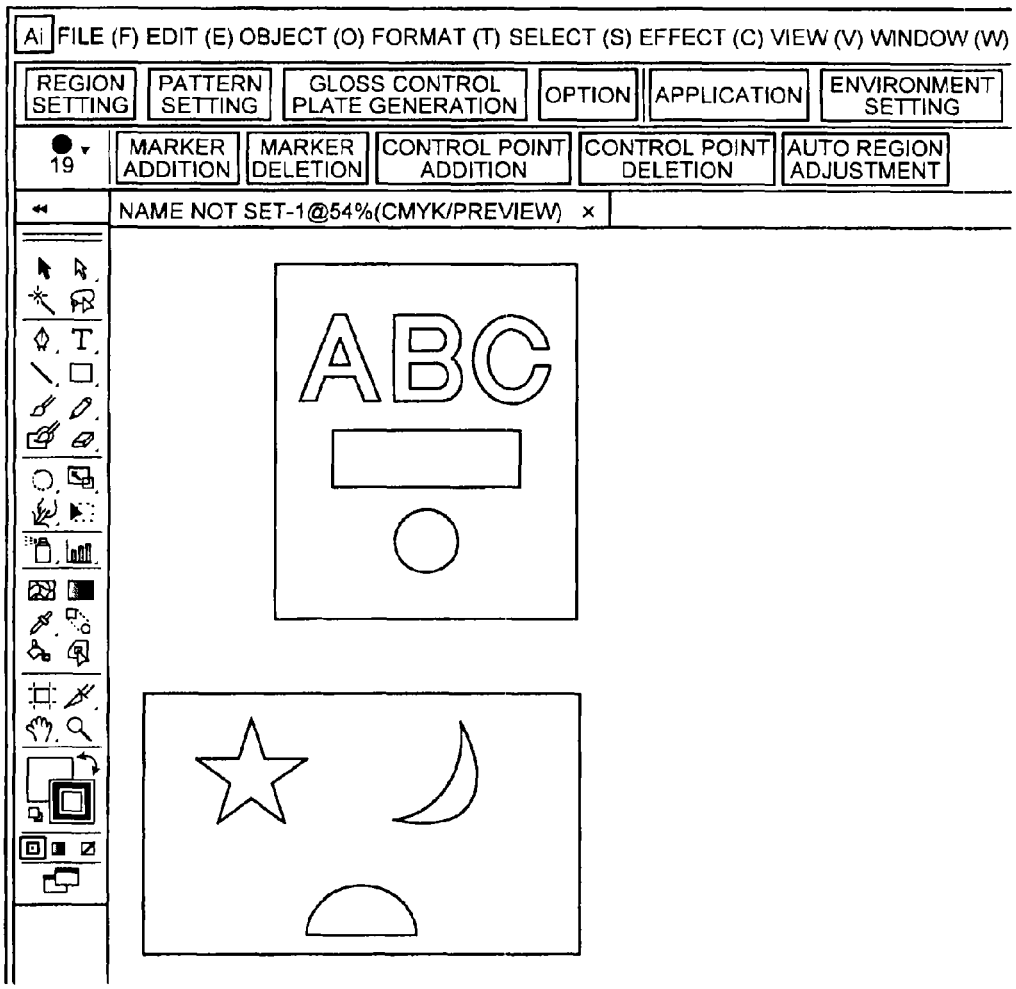
FIG. 27 is a diagram of a screen example displayed by the UI providing unit.
Figure 28:
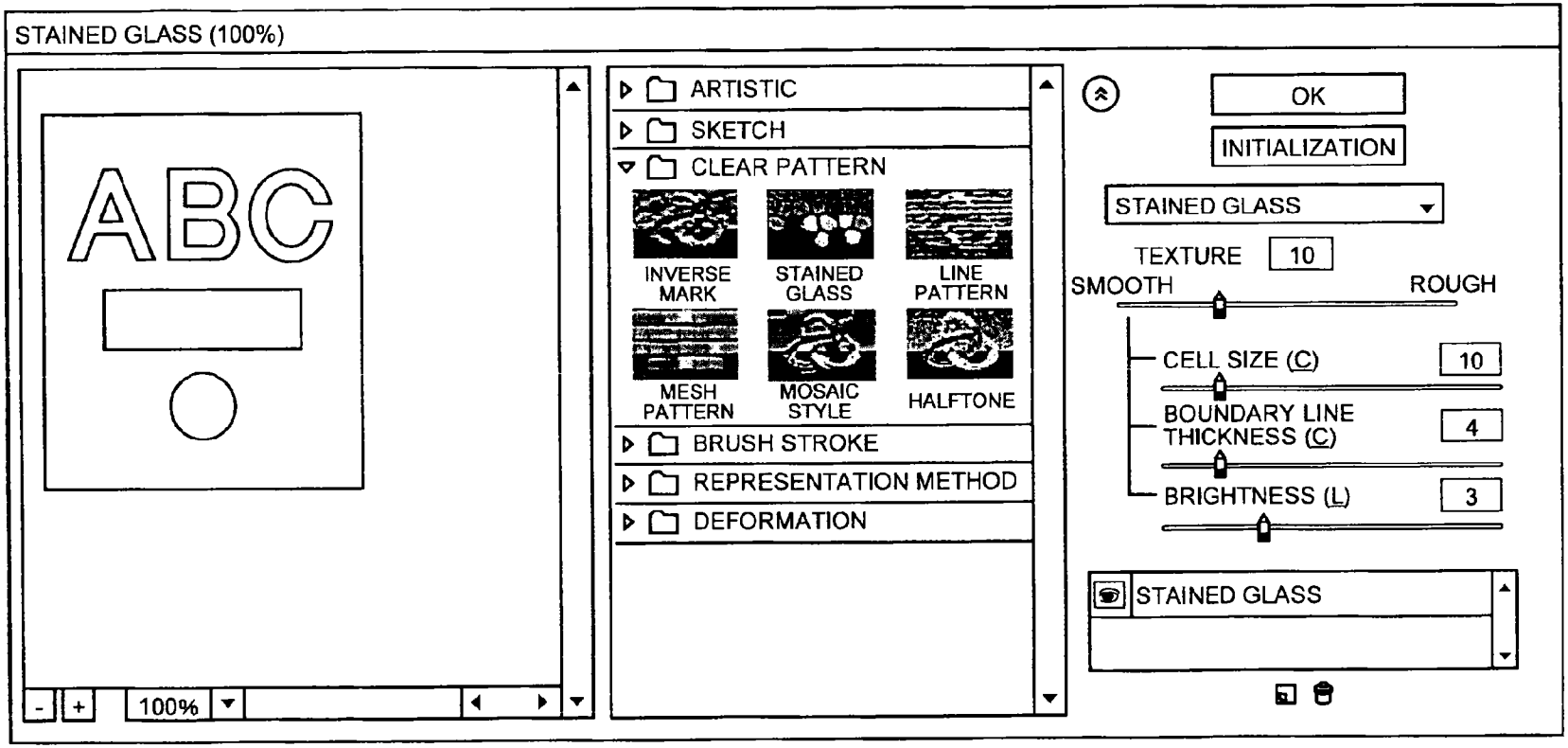
FIG. 28 is a diagram of a screen example displayed by the UI providing unit.

In this embodiment, unlike that first embodiment in which the region to which the surface effect is imparted is decided in advance, it is possible to impart the surface effect in a unit of a rendering object according to a user. Therefore, the UI providing unit 181 in this embodiment causes the display unit 14 to display, for example, a screen shown as an example in FIG. 27 via the display control unit 121. FIG. 27 is an example of a screen displayed when plug-in is incorporated in Illustrator sold by Abode Systems® Incorporated. In the screen shown in FIG. 27, an image represented by target image data (image data of the color plate), which is a processing target, is displayed. The user presses a marker addition button via the input unit 13 and performs operation input for designating a region to which the user desires to impart a surface effect, whereby the region to which the surface effect is imparted is designated. The user performs such operation input for all regions to which surface effects are imparted. The UI providing unit 181 of the host apparatus 10 causes the display unit 14 to display a screen shown as an example in FIG. 28 via the display control unit 121, for example, for each designated region. On the screen shown in FIG. 28, in each region designated as a region to which a surface effect is imparted, an image of the region is displayed. The user performs, via the input unit 13, operation input for designating a type of a surface effect that the user desires to impart to the image, whereby the type of the surface effect imparted to the region is designated. As the type of the surface effect, the Premium Gloss and the Gloss shown in FIG. 3 are represented as "inverse mask" in FIG. 28. Other effects excluding the Premium Gloss and the Gloss shown in FIG. 3 are represented as stained glass, parallel line pattern, mesh pattern, mosaic style, Matte, and halftone. It is indicated that the respective surface effects can be designated.

Figure 29:
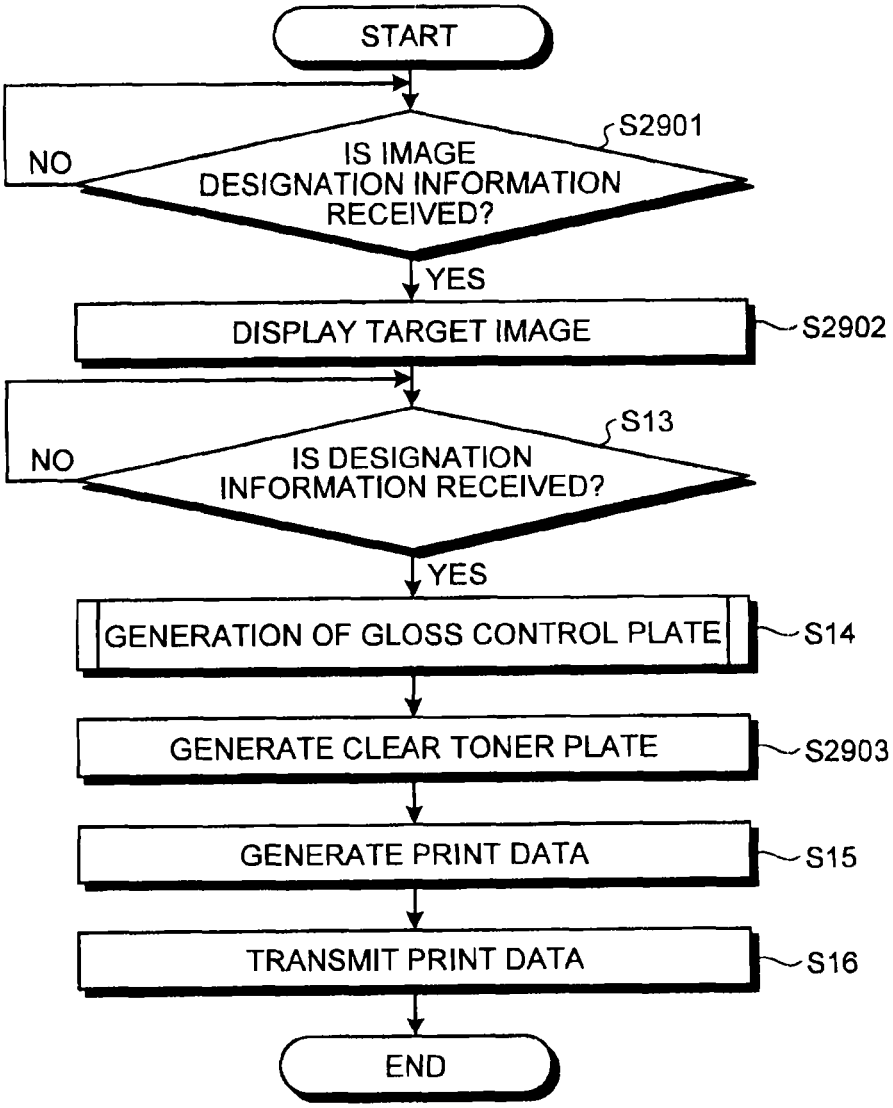
FIG. 29 is a flowchart for explaining a procedure of processing for generating print data by a host apparatus according to a second embodiment.

Processing for generating print data by the host apparatus 10 configured as explained above is explained below. FIG. 29 is a flowchart for explaining a procedure of the processing for generating print data by the host apparatus 10 according to the second embodiment.

First, when the input control unit 124 receives the input of image designation information (Yes at step S2901), the display control unit 121 controls the display unit 14 to display an image designated by the received image designation information (step S2902). Subsequently, when the input control unit 124 receives the input of designation information of a surface effect (Yes at step S13), the plate-data generating unit 122 generates image data of the gloss control plate based on the received designation information (step S14).

Concerning processing for generating the gloss control plate, at step S31 explained with reference to FIG. 15, a rendering object in which a surface effect is imparted to a target image and a coordinate of the rendering object are specified by designation information of the user. The other processing from steps S32 to S35 is the same as the processing in the first embodiment explained with reference to FIG. 15.

When the image data of the gloss control plate is generated, the clear-toner-plate generating unit 311 generates image data of the clear toner plate (step S2903), generates document data obtained by integrating the image data of the gloss control plate, the image data of the color plate of the target image, and the clear toner plate, and passes the document data to the print-data generating unit 123. The print-data generating unit 123 generates print data based on the document data (step S15). When a transparent image is designated, image data of the clear plate is also generated and included in the document data to generate print data. Consequently, the print data is generated. The communication unit 15 transmits the generated print data to the DFE 50 (step S16).

In the second embodiment, the print data including the gloss control plate data is transmitted to the DFE 50 and thus the DFE 50 determines whether to turn the glosser 80 on or off. Alternatively, the host apparatus 10 may determine whether to turn the glosser 80 on or off and transmit the on/off information to the DFE 50.

Figure 30:
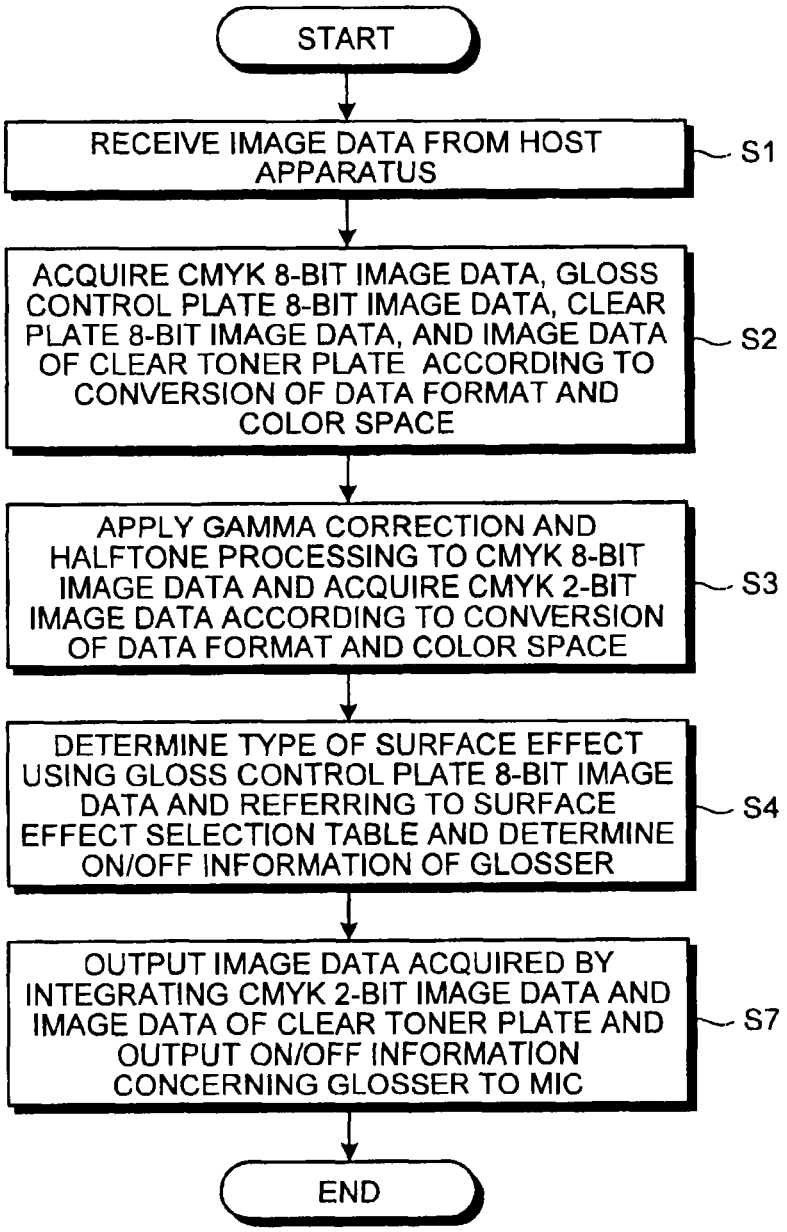
FIG. 30 is a flowchart for explaining a procedure of gloss control processing performed by a DFE according to the second embodiment.

A procedure of gloss control processing performed by the DFE 50 according to this embodiment is explained below with reference to FIG. 30. The configuration of the DFE 50 according to this embodiment is same as that in the first embodiment. However, the clear processing unit 56 is different from that in the first embodiment in that the clear processing unit 56 does not generate image data of the clear toner plate.

When the DFE 50 receives print data from the host apparatus 10 (step S1), the rendering engine 51 subjects the print data to language interpretation, converts image data represented in the vector format into the raster format, and converts a color space represented in the RGB format into a color space of the CMYK format to obtain 8-bit color plate image data of each of CMYK, 8-bit gloss control plate image data, 8-bit clear plate image data, and image data of the clear toner plate (step S2).

The processing for converting the image data of the gloss control plate at step S2 is the same as the processing in the first embodiment explained with reference to FIG. 16.

When the 8-bit gloss control plate image data is output, the TRC 53 of the DFE 50 applies gamma correction to the 8-bit color plate image data of each of CMYK using a gamma curve of a 1D_LUT generated by calibration. The halftone engine 55 applies, to the image data subjected to the gamma correction, halftone processing for converting the image data into a data format of 2-bit color plate image data of each of CMYK for output to the printer machine 70 and obtains the 2-bit color plate image data of each of CMYK (step S3).

The clear processing unit 56 of the DFE 50 determines a surface effect designated for pixel values indicated by the gloss control plate using the 8-bit gloss control plate and referring to the surface effect selection table. The clear processing unit 56 performs such determination on all of the pixels included in the gloss control plate. In the gloss control plate, all pixels included in a region to which surface effects are imparted basically show density values in the same range. Therefore, the clear processing unit 56 determines that pixels near the pixels determined as having the same surface effect are included in the region to which the same surface effect is imparted. As described above, the clear processing unit 56 determines the region to which the surface effect is imparted and the type of the surface effect imparted to the region. The clear processing unit 56 determines on or off of the glosser 80 according to the determination (Step S4).

The si3 unit 57 of the DFE 50 integrates the 2-bit color plate image data of each of CMYK subjected to the halftone processing obtained at step S3 and the image data of the clear toner plate and outputs the integrated image data and the on/off information indicating on or off of the glosser 80 determined at step S4 to the MIC 60 (step S7).

As explained above, according to the second embodiment, during printing of image data, when the user selects a desired surface effect from the surface effect selection screen displayed on the display unit 14, the printer driver 31 of the host apparatus 10 generates the gloss control plate and the clear toner plate corresponding to the selected surface effect and transmits the gloss control plate and the clear toner plate to the DFE 50 together with CMYK color plate image data of the image data. The DFE 50 determines, using the gloss control plate and according to a type of the post-processor such as the glosser 80 or the low-temperature fixing unit 90 behind the printer machine 70, presence or absence of post-processing in the post-processor. The DFE 50 deposits the clear toner on an image formed by toner images of CMYK using the clear toner plate. Consequently, it is possible to impart a common surface effect in image forming systems having various configurations. It is possible to impart various surface effects by depositing the clear toner on the image formed by the toner images of CMYK using the clear toner plate transmitted from the host apparatus 10. Therefore, the user can impart a desired surface effect by the clear toner to a print, on which an image is formed, without consuming labor and time. Because the host apparatus 10 generates the clear tone plate, it is possible to reduce a load related to the processing in the DFE 50.

Figure 31:
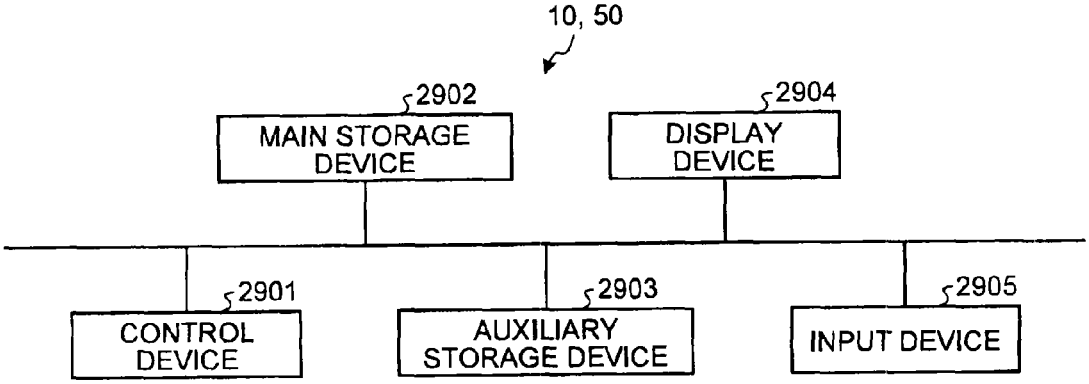
FIG. 31 is a hardware configuration diagram of the host apparatus and the DFE.

A hardware configuration of the host apparatus 10 and the DFE 50 according to the embodiments is explained. FIG. 31 is the hardware configuration of the host apparatus 10 and the DFE 50. The host apparatus 10 and the DFE 50 mainly includes, as the hardware configuration, a control device 2901 such as a CPU that controls the entire apparatus, a main storage device 2902 such as a Read Only Memory (ROM) or a random access memory (RAM) that stores various data and various computer programs, an auxiliary storage device 2903 such as a hard disk drive (HDD) that stores various data and various computer programs, an input device 2905 such as a keyboard or a mouse, and a display device 2904 such as a display. The host apparatus 10 and the DFE 50 have a hardware configuration including a normal computer.

A printer driver program executed by the host apparatus 10 according to the embodiments is provided as a computer program product while being recorded in a computer-readable recording medium such as a compact disc read-only memory (CD-ROM), a flexible disk (FD), a compact disc-recordable (CD-R), or a digital versatile disk (DVD) as a file of an installable format or an executable format.

The printer driver program executed by the host apparatus 10 according to the embodiments can be stored on a computer connected to a network such as the Internet and provided by being downloaded through the network. The printer driver program executed by the host apparatus 10 according to the embodiments can be provided or distributed through the network such as the Internet.

The printer driver program executed by the host apparatus 10 according to the embodiments can be incorporated on a ROM or the like and provided.

An image processing program executed by the host apparatus 10 according to the embodiments has a module configuration including the units explained above (the printer driver, the input control unit, the display control unit, etc.). As actual hardware, a CPU (a processor) reads out the printer driver program from the storage medium and executes the control program, whereby the units are loaded onto a main storage device and the printer driver, the input control unit, the display control unit, and the like are generated on the main storage device.

Print control processing executed by the DFE 50 according to the embodiments can be realized by a print control program functioning as software besides being realized by hardware. In this case, the print control program executed by the DFE 50 according to the embodiments is provided while being installed in a ROM or the like in advance.

The print control program executed by the DFE 50 according to the embodiments can be recorded in a computer-readable recording medium such as a CD-ROM, an FD, a CD-R, or a DVD in an installable format or an executable format and provided as a computer program product.

The print control program executed by the DFE 50 according to the embodiments can be stored on a computer connected to a network such as the Internet and provided by being downloaded via the network. The print control program executed by the DFE 50 according to the embodiments can be provided or distributed via the network such as the Internet.

The print control program executed by the DFE 50 according to the embodiments has a module configuration including the units (the rendering engine, the halftone engine, the TRC, the si1 unit, the si2 unit, the si3 unit, and the clear processing unit). As actual hardware, a CPU (processor) reads out the print control program from the ROM and executes the print control program, whereby the units are loaded onto the main storage device and the rendering engine, the halftone engine, the TRC, the si1 unit, the si2 unit, the si3 unit, and the clear processing unit are generated on the main storage device.

The present invention is not limited to the embodiments per se. In an implementation stage, the elements can be modified and embodied without departing from the spirit of the present invention. Various inventions can be devised by combining, as appropriate, a plurality of elements disclosed in the embodiments. For example, several elements can be deleted from all the elements disclosed in the embodiments. The elements disclosed in the different embodiments can be appropriately combined. As explained below as examples, various modifications are possible.

In the embodiment explained above, the image forming system includes the host apparatus 10, the DFE 50, the MIC 60, the printer machine 70, the glosser 80, and the low-temperature fixing unit 90. However, this is not a limitation. For example, the DFE 50, the MIC 60, and the printer machine 70 can be integrally formed as one image forming apparatus or can be formed as an image forming apparatus further including the glosser 80 and the low-temperature fixing unit 90.

In the image forming systems according to the embodiments, an image is formed using toners of a plurality of colors of CMYK. However, an image can be formed using a toner of a single color.

The image forming systems according to the embodiments include the MIC 60. However, this is not a limitation. The processing and the functions of the MIC 60 can be provided in another apparatus such as DFE 50. The MIC 60 does not have to be provided.

According to the embodiments, there is an effect that it is possible to impart, without causing a user trouble, a desired surface effect by a clear toner to a recording medium on which an image is formed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An information processing apparatus connected to a print control apparatus for generating image data, the information processing apparatus comprising:

circuitry configured to generate image data for specifying a type of a surface effect imparted to a recording medium; and transmit the image data to the print control apparatus.

2. The information processing apparatus according to claim 1, wherein the circuitry generates the image data for specifying the type of a surface effect and for specifying a region in the recording medium to which the surface effect is imparted.

3. The information processing apparatus according to claim 2, wherein, in the image data, a gloss control value for specifying the type of the surface effect and the region in the recording medium to which the surface effect is imparted is designated for each pixel.

4. The information processing apparatus according to claim 3, wherein the circuitry generates the image data in which the gloss control value is designated for a rendering object that is included in a region set in advance.

5. The information processing apparatus according to claim 3, wherein the circuitry is further configured to generate, based on the image data, another image data corresponding to presence or absence of one or a plurality of post-processors connected to a printing apparatus and a type(s) of the post-processor(s).

6. The information processing apparatus according to claim 5, wherein the circuitry generates the image data in which the gloss control value is designated for each rendering object that is designated by a user.

7. A method for controlling an information processing apparatus connected to a print control apparatus for generating image data, the method comprising:

generating, in the information processing apparatus, image data for specifying a type of a surface effect imparted to a recording medium; and transmitting, from the information processing apparatus, the image data to the print control apparatus.

8. The method according to claim 7, wherein the generating includes generating the image data for specifying the type of a surface effect and for specifying a region in the recording medium to which the surface effect is imparted.

9. The method according to claim 8, wherein, in the image data, a gloss control value for specifying the type of the surface effect and the region in the recording medium to which the surface effect is imparted is designated for each pixel.

10. The method according to claim 9, wherein the generating includes generating the image data in which the gloss control value is designated for a rendering object that is included in a region set in advance.

11. The method according to claim 9, further comprising generating, based on the image data, another image data corresponding to presence or absence of one or a plurality of post-processors connected to a printing apparatus and a type(s) of the post-processor(s).

12. The method according to claim 11, wherein the generating the image data includes generating the image data in which the gloss control value is designated for each rendering object that is designated by a user.

13. A non-transitory computer-readable storage medium storing computer-readable instructions thereon, which, when executed by a computer, cause the computer to perform a method for controlling an information processing apparatus connected to a print control apparatus for generating image data, the method comprising:

generating, in the information processing apparatus, image data for specifying a type of a surface effect imparted to a recording medium; and transmitting, from the information processing apparatus, the image data to the print control apparatus.

14. The non-transitory computer-readable storage medium according to claim 13, wherein the generating includes generating the image data for specifying the type of a surface effect and for specifying a region in the recording medium to which the surface effect is imparted.

15. The non-transitory computer-readable storage medium according to claim 14, wherein, in the image data, a gloss control value for specifying the type of the surface effect and the region in the recording medium to which the surface effect is imparted is designated for each pixel.

16. The non-transitory computer-readable storage medium according to claim 15, wherein the generating includes generating the image data in which the gloss control value is designated for a rendering object that is included in a region set in advance.

17. The non-transitory computer-readable storage medium according to claim 15, further comprising generating, based on the image data, another image data corresponding to presence or absence of one or a plurality of post-processors connected to a printing apparatus and a type(s) of the post-processor(s).

18. The non-transitory computer-readable storage medium according to claim 17, wherein the generating the image data includes generating the image data in which the gloss control value is designated for each rendering object that is designated by a user.

* * * * *